US005220129A

United States Patent [19]

Nishio et al.

[11] Patent Number: 5,220,129

[45] Date of Patent: Jun. 15, 1993

[54] DEVELOPING DEVICE USED IN ELECTROPHOTOGRAPHIC FIELD

[75] Inventors: Yukio Nishio, Tama; Kazunori Hirose, Hiratsuka, both of Japan

[73] Assignee: Fujitsu Ltd., Kanagawa, Japan

[21] Appl. No.: 785,403

[22] Filed: Oct. 30, 1991

Related U.S. Application Data

[62] Division of Ser. No. 494,392.

[30] Foreign Application Priority Data

| | | | |
|---|---|---|---|
| Mar. 20, 1989 | [JP] | Japan | 1-068129 |
| Apr. 6, 1989 | [JP] | Japan | 1-087451 |
| Apr. 6, 1989 | [JP] | Japan | 1-087452 |
| May 27, 1989 | [JP] | Japan | 1-133354 |

[51] Int. Cl.[5] ..... G03G 15/08

[52] U.S. Cl. ..... 118/656; 355/251; 355/259

[58] Field of Search ..... 355/245, 246, 253, 259; 118/656, 658, 651, 653, 657

[56] References Cited

U.S. PATENT DOCUMENTS

| | | | |
|---|---|---|---|
| 3,754,963 | 8/1973 | Chang | 118/637 |
| 3,866,572 | 2/1975 | Gundlach | 118/637 |
| 4,100,884 | 7/1988 | Mochizuki et al. | 118/653 |
| 4,267,245 | 5/1981 | Wada | 118/652 X |
| 4,373,798 | 2/1983 | Tsukada et al. | 118/658 X |
| 4,478,505 | 10/1984 | Tashiro | 355/245 |
| 4,579,081 | 4/1986 | Kohyama | 118/651 |
| 4,755,847 | 7/1988 | Matsushiro et al. | 355/259 |
| 4,760,422 | 7/1988 | Seimiya et al. | 355/253 |
| 4,827,305 | 5/1989 | Enoguchi et al. | 355/259 |

FOREIGN PATENT DOCUMENTS

| | | | |
|---|---|---|---|
| 0387096A3 | 9/1990 | European Pat. Off. . | |
| 0388233A2 | 9/1990 | European Pat. Off. . | |
| 0095559 | 5/1987 | Japan | 355/259 |
| 2128109A | 4/1984 | United Kingdom . | |

OTHER PUBLICATIONS

Patent Abstracts of Japan, vol. 13, No. 27 (P-815) (3375), Jan. 20, 1989, JP 63-225259 (A).

Patent Abstracts of Japan, vol. 11, No. 303 (P-622) (2750), Oct. 3, 1987, JP 62-95559 (A).

*Primary Examiner*—A. T. Grimley

*Assistant Examiner*—Christopher Horgan

*Attorney, Agent, or Firm*—Armstrong, Westerman, Hattori, McLeland & Naughton

[57] ABSTRACT

A developing device using a one-component developer composed of colored fine synthetic resin toner particles, which device comprises a vessel for holding the developer, and a developing roller rotatably provided within the vessel, a portion thereof being exposed therefrom and resiliently pressed against a surface of a photosensitive drum. The toner particles are held by the surface of the developing roller to form a developer layer therearound, and are carried to the surface of the image formation drum for development of an electrostatic latent image formed thereon. The developing device further comprises a blade member provided within the vessel and resiliently engaged with the developing roller for regulating a thickness of the developer layer formed therearound. The blade member is constituted such that a proper regulation of the developer layer can be always ensured.

12 Claims, 21 Drawing Sheets

DEVELOPING DEVICE USED IN ELECTROPHOTOGRAPHIC FIELD

This is a division of application Ser. No. 494,352 filed Mar. 16, 1990, now U.S. Pat. No. 5,097,294.

BACKGROUND OF THE INVENTION

1) Field of the Invention

The present invention relates to a developing device used in an electrophotographic field, wherein an electrostatic latent image is visually developed by using a non-magnetic type one-component developer.

2) Description of the Related Art

As is well known, an electrophotographic printer carries out the processes of: producing a uniform distribution of electrical charges on a surface of an electrostatic latent image carrying body; forming an electrostatic latent image on the electrically charged surface of the electrostatic latent image carrying body by optically writing an image thereon by using a laser beam scanner, an LED (light emitting diode) array, an LCS (liquid crystal shutter) array or the like; visually developing the electrostatic latent image with a developer, i.e., toner, which is electrically charged to be electrostatically adhered to the electrostatic latent image zone; electrostatically transferring the developed visible image to a sheet or paper; and fixing the transferred image on the sheet or paper. Typically, the electrostatic latent image carrying body may be an electrophotographic photoreceptor, usually formed as a photosensitive drum, having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as this enables a stable development of the latent image. Note, typically the toner particles have an average diameter of about 10 μm, and the magnetic carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller, provided within the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed thereon. In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held by the vessel, to supplement the toner component as it is consumed during the development process, whereby the component ratio of the two-component developer held by the vessel is kept within the predetermined range. This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using same does not suffer from the above-mentioned disadvantages of the developing device using the two-component developer, because the one-component developer is composed of only a toner component (colored fine synthetic resin particles). Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles of which the magnetic type one-component developer is composed includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. Nos. 3,152,012 and 3,754,963. This developing device includes a vessel for holding the non-magnetic type one-component developer, and a conductive solid rubber roller rotatably provided within the vessel as a developing roller in such a manner that a portion of the solid rubber developing roller is exposed therefrom and faces the surface of the photosensitive drum. The solid rubber developing roller may be formed of a conductive silicone rubber material or a conductive polyurethane rubber material, as disclosed in Japanese Examined Patent Publication (Kokoku) No. 60-12627 and Japanese Unexamined Patent Publications (Kokai) No. 62-118372 and No. 63-189876. When the conductive solid rubber developing roller is rotated within the body of the non-magnetic type one-component developer held by the vessel, the toner particles composing the non-magnetic type one-component developer are frictionally entrained by the surface of the solid rubber developing roller to form a developer layer therearound, whereby the toner particles can be brought to the surface of the photosensitive drum for the development of the electrostatic latent image formed thereon. The developing device further includes a blade member engaged with the surface of the developing roller, to uniformly regulate a thickness of the developer layer formed therearound so that an even development of the latent image can be carried out. The blade member also serves to electrically charge the toner particles by a triboelectrification therebetween. In this developing device, the development process is carried out in such a manner that, at the area of contact between the photosensitive drum and the conductive solid rubber developing roller carrying the developer layer, the charged toner particles are electrostatically attracted and adhered to the latent image due to a developing bias voltage applied to the conductive solid rubber developing roller.

Japanese Unexamined Patent Publication (Kokai) No. 62-96981 discloses a developing device using the one-component developer, in which a rubber blade member is used to regulate a thickness of the developer layer formed around the developing roller. This rubber blade member is in the form of a rectangular plate element and has a width substantially equal to a length of the developing roller. The rubber blade member is slidably received in a guide holder member, and is resiliently pressed against the developing roller. A bottom end face of the blade member, which is in contact with the surface of the developing roller, is formed as a slant face so that the blade member has acute and obtuse angle edges at the bottom end face thereof, and the blade member is engaged with the rotating developing roller in such a manner that the acute angle edge thereof penetrates the developer layer formed around the developing roller. With this arrangement, even though the developing roller is eccentrically rotated (note, a slight eccentric rotation of the developing roller is permissible as a tolerance), the contact between the slant end face of the blade member and the surface of the developing roller is maintained because the blade member is resiliently pressed against the developing roller, and thus a regulation of the developing layer thickness can be ensured by the penetration of the acute angle edge of the blade member to the developer layer.

Nevertheless, the above-mentioned rubber blade member has a disadvantage of a susceptibility to mechanical damage, i.e., the acute angle edge of the blade member can be easily chipped away, and obviously, an even regulation of the developer layer thickness cannot be ensured by a chipped acute angle edge of the blade member. Also, in the developing device disclosed in the above-mentioned Publication (Kokai) No. 62-96981, the excess toner particles removed from the developer layer by the blade member are not prevented from entering the guide holder member in which the blade member is slidably received, so that the blade member may become immovable in the guide holder member, and of course, when the blade member is immovable in the guide holder member, it is impossible to properly regulate the developer layer thickness. Furthermore, when a frictional force between the blade member and the developing roller with the developer layer becomes large, due to variations in the temperature and air moisture content, the blade member may be vibrated for the reasons stated hereinafter in detail, and thus variations of the regulated developer layer thickness appear.

The blade member also serves to electrically charge the toner particles by a triboelectrification therebetween, as mentioned above. In this case, the blade member must be constituted in such a manner that the toner particles forming the regulated developer layer can be given a charge distribution that will produce a proper development of an electrostatic latent image, since if this is not ensured, an electrophotographic fog may appear during the development process and the developer be wastefully consumed for the reasons stated hereinafter in detail.

SUMMARY OF THE INVENTION

Therefore, an object of the present invention is to provide a developing device using a one-component developer, particularly a non-magnetic type one-component developer used in the electrophotographic filed, which device comprises a conductive developing rubber roller for entraining the developer particles or toner particles to form a developer layer therearound and bringing the toner particles to an electrostatic latent image carrying body for a development of an electrostatic latent image formed thereon, and a blade member for regulating a thickness of the developer layer formed around the developing roller to carry out an even development of the latent image, wherein the blade member is arranged in such a manner that a regulation of the developer layer thickness can be properly and stably maintained over a long period.

Another object of the present invention is provide a developing device as mentioned above, wherein the blade member is constituted in such a manner that the toner particles forming the regulated developer layer are given a charge distribution such that a proper development of the latent image can be obtained.

In accordance with an aspect of the present invention, there is provided a developing device using a one-component developer, which device comprises: a vessel for holding a one-component developer composed of toner particles; a developing roller rotatably provided within the vessel in such a manner that a portion of the developing roller is exposed therefrom and faces a surface of an electrostatic latent image carrying body; the toner particles being formed of a conductive rubber material by which the toner particles are entrained to form a developer layer therearound and are carried to the surface of the electrostatic latent image carrying body for development of an electrostatic latent image formed thereon; and a blade member provided within the vessel and resiliently engaged with the developing roller for regulating a thickness of the developer layer formed therearound, the blade member having an obtuse angle edge by which the regulation of the developer layer thickness is carried out. The obtuse angle edge of the blade member is not susceptible to mechanical damage, whereby a proper regulation of the developer layer thickness by the blade member can be ensured over a long period.

In accordance with another aspect of the present invention, the blade member is slidably received in a guide holder member, and has a plate element by which the excess toner particles removed by the blade member from the developer layer are prevented from entering into the guide holder member, and returned to the developer held in the vessel. With this arrangement, the blade member is prevented from becoming immovable in the guide holder due to the entering of the toner particles therein, whereby the operating life of the blade member can be prolonged.

In accordance with yet another aspect of the present invention, a blade member for regulating a thickness of the developer layer formed around the developing roller is pivotally provided within the vessel so as to be resiliently and tangentially engaged with the developing roller, a center of the pivotal movement of the blade member being positioned on a tangential line defined between the blade member and the developing roller. With this arrangement, it is possible for the blade member to carry out the regulation of the developer layer thickness without being affected by a frictional force between the blade member and the developing roller, whereby a proper regulation of the developer layer thickness can be ensured. The blade member may have a round edge element resiliently pressed against the developing roller for carrying out the regulation of the developer layer thickness. Also, the blade member may have a plate element by which the excess toner particles removed by the blade member from the developer layer are returned to the developer held in the vessel.

In the developing device according to the present invention, the developing roller is preferably formed of a conductive open-cell foam rubber material so that pore openings appear over the surface of the developing roller, the pore openings having a diameter which is at most twice an average diameter of the toner particles, whereby, during a rotation of the developing roller, the toner particles are captured and held by the pore openings of the developing roller.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
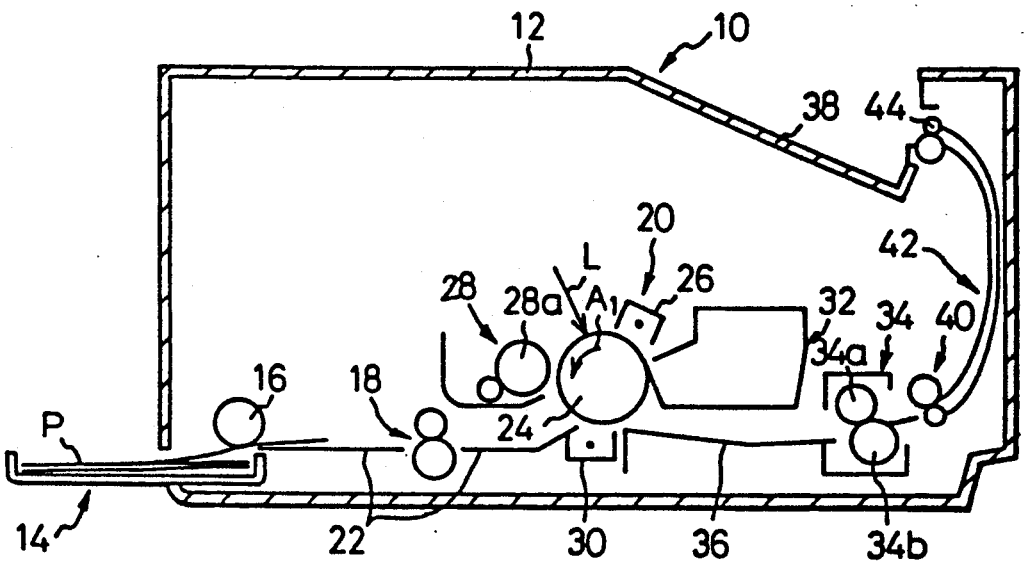
FIG. 1 is a schematic view showing an electrophotographic printer to which a developing device according to the present invention is applied.

FIG. 1 is a schematic diagram showing an electrophotographic printer, generally designated by reference numeral 10, to which a developing device using a non-magnetic type one-component developer according to the present invention is applied. The printer 10 includes a frame housing 12 provided with a sheet supply tray 14 incorporated into an end side wall of the frame housing 12 in the vicinity of a bottom thereof, and wherein a stack of sheets or paper to be printed is held. The sheet supply tray 14 is provided with a pickup roller 16 by which papers P are drawn out one by one from the stack of sheet or paper held in the sheet supply tray 14. The drawn-out paper P is moved toward a pair of feed rollers 18 by which the paper P is then introduced into a recording or printing station, generally designated by reference numeral 20. Particularly, when a leading edge of the paper P enters between the feed rollers 18, an electric motor (not shown) for the feed rollers 18 is once stopped so that the paper P is stopped, and thereafter, the standby-condition of the paper P is released at a given timing, and thus the paper P is timely introduced into the printing station 20, whereby a recording or printing can be carried out at a proper position with respect to the paper P. Note, in FIG. 1, reference numeral 22 designates guide plates forming a travel path of the paper P.

At the printing station 20, a photosensitive drum 24 is placed as a latent image carrying body, and is rotated at a constant speed in a direction indicated by an arrow $A_1$ during the printing operation. As shown in FIG. 1, a charger 26, a developing device 28, a transfer charger 30, and a cleaner 32 are successively disposed around the photosensitive drum 24 in the direction of rotation thereof. Note, the developing device 28 is constructed according to the present invention, and is shown together with the photosensitive drum 24 in FIG. 2.

Figure 2:
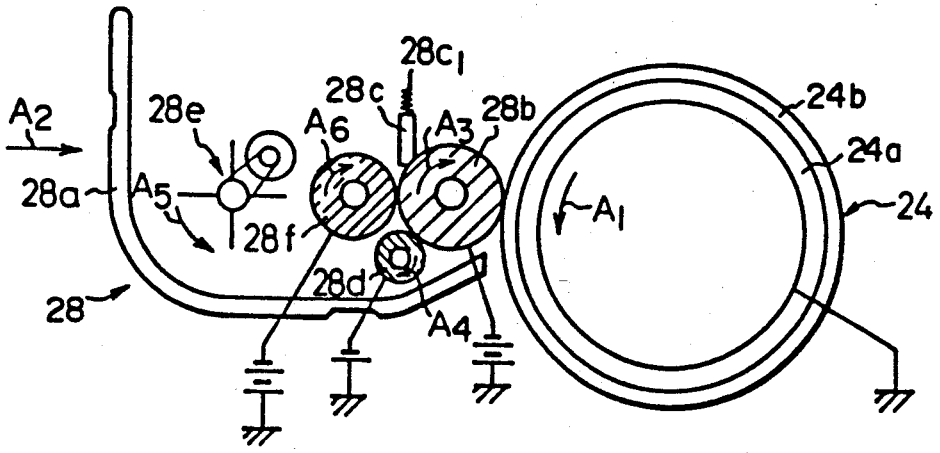
FIG. 2 is a schematic view showing an embodiment of the developing device according to the present invention.

As shown in FIG. 2, the photosensitive drum 24 comprises a sleeve substrate **24*a* made of a suitable conductive material such as aluminum, and a photoconductive material film 24*b* formed therearound. The sleeve substrate 24*a* is grounded as illustrated in FIG. 2, and the photoconductive material film 24*b*** may be composed of an organic photoconductor (OPC), a selenium photoconductor or the like.

The charger 26 may comprise a corona discharger. For example, when the photoconductive material film **24*b* of the drum 24 is made of the organic photoconductor, the charger 26 is arranged to apply negative charges to the surface (OPC) of the photosensitive drum 24, so that a uniform distribution of the charges is produced on the drum surface. The printer is provided with an optical writing means (not shown) such as a laser beam scanner, an LED (light emitting diode) array, an LCS (liquid crystal shutter) array, or the like, for forming an electrostatic latent image on the charge area of the photosensitive drum 24. As shown in FIG. 1, the charged area of the drum 24 is illuminated with a light beam L emitted from the optical writing means, and the charges are released from the illuminated zone through the grounded sleeve substrate 24*a***, so that a potential difference between the illuminated zone and the remaining zone forms an electrostatic latent image (i.e., the illuminated zone).

As shown in FIG. 2, the developing device 28 comprises a vessel **28*a* supported by a frame structure of the printer 10 in such a manner that the vessel 28*a* is movable toward and away from the photosensitive drum 24. The vessel 28** receives a non-magnetic type one-component developer composed of colored fine toner particles of a suitable synthetic resin, such as polyester and styrene acrylic resin, and usually having an average diameter of about 10 μm.

The developing device 28 also comprises a conductive rubber roller **28*b* rotatably provided within the vessel 28*a* as a developing roller, a portion of which is exposed from the vessel 28*a*. The vessel 28*a* is resiliently biased in a direction indicated by an arrow $A_2$, by a suitable resilient element (not shown) such as a coil or leaf spring, so that the exposed portion of the developing roller 28*b* is resiliently pressed against the surface of the photosensitive drum 24. During the operation of the developing device 28, the developing roller 28*b* is rotated in a direction indicated by arrow $A_3$, and frictionally entrains the toner particles to form a developer layer therearound, whereby the toner particles are brought to the surface of the photosensitive drum 24 for the development of the latent image formed thereon. For example, the photosensitive drum 24 may have a diameter of 60 mm and a peripheral speed of 70 mm/s. Further, the developing roller 28*b* may have a diameter of 20 mm and a peripheral speed of from 1 to 4 times that of the photosensitive drum 24. The developing roller 28*b* includes a shaft rotatably supported by the walls of the vessel 28*a***, and a roller element mounted thereon.

The roller element of the developing roller **28*d* is preferably formed of a conductive open-cell foam rubber material such as a conductive open-cell polyurethane foam rubber material, a conductive open-cell silicone foam rubber material, or a conductive open-cell acrylonitrile-butadiene foam rubber material, whereby the toner particles can be effectively and stably entrained because they are captured and held in pore openings of the open-cell foam rubber roller elements. If the developing roller formed of the rubber material has a solid rubber surface, as disclosed in the above-mentioned Publications No. 60-12627, No. 62-118372, and No. 63-189876, a coefficient of the surface friction thereof is changed by variations in the environment, particularly in the temperature and air moisture content. Accordingly, when the friction coefficient of the solid rubber developing roller becomes low, an amount of toner particles necessary for the development of the latent image cannot be entrained by the solid rubber developing roller. Note, the roller element of the developing roller 28*b* preferably has a volume resistivity of about $10^4$ to $10^{10}$ Ω. m, most preferably $10^5$ Ω. m, and an Asker-C hardness of about 10° to 35°, most preferably 10°. The developing roller 28*b* is pressed against the photosensitive drum 24 with a linear pressure of about 22 to 50 g/cm, most preferably 43 g/cm, so that a contact or nip width of about 1 to 3.5 mm can be obtained between the developing roller 18 and the photosensitive drum 24**.

Figure 3:
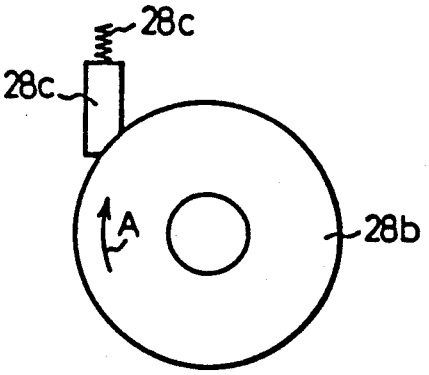
FIG. 3 is a partially enlarged view of FIG. 2, showing a developing roller and a blade member resiliently engaged therewith.

The developing device 28 further comprises a blade member **28*c* engaged with the surface of the developing roller 28*b* to uniformalize a thickness of the developer layer formed therearound, whereby an even development of the latent image is ensured. The blade member 28*c* is suitably supported so that it is resiliently pressed against the developing roller 28*b* by a spring means $28c_1$ (as best shown in FIG. 3) at a linear pressure of about 26 g/mm, to regulate the thickness of the developer layer formed therearound. In this embodiment, the blade member 28c is formed of a suitable non-conductive or conductive synthetic resin material, but may be further formed of a suitable metal material such as aluminum, stainless steel, brass or the like. The blade member 28c** may also serve to electrically charge the toner particles by a triboelectrification therebetween.

The developing device 28 further comprises a toner-removing roller 28d rotatably provided within the vessel 28a and in contact with the developing roller 28b in such a manner that a contact or nip width of about 1 mm may be obtained therebetween. The toner-removing roller 28d is rotated in the same direction as the developing roller 28b, as indicated by an arrow $A_4$, so that the surfaces of the toner-removing roller 28d and the developing roller are rubbed against each other in counter directions at the contact area therebetween, whereby remaining toner particles not used for the development of the latent image are mechanically removed from the developing roller 28b. The toner-removing roller 28d is formed of a conductive synthetic resin foam material, preferably a conductive open-cell foam polyurethane rubber material which has a volume resistivity of about $10^6$ Ω.m, and an Asker-C hardness of about 10° to 70°, most preferably 30°. For example, the toner-removing roller 28d may have a diameter of 11 mm, and a peripheral speed of from 0.5 to 2 times that of the developing roller 28b.

Further, the developing device 28 comprises an agitator 28e for agitating the non-magnetic type one-component developer to eliminate a dead stock thereof from the vessel 28a, and a fur brush roller 28f for electrostatically feeding the toner particles to the developing roller 28b. As shown in FIG. 2, the agitator 28e is rotated in a direction indicated by an arrow $A_5$, so that a portion of the developer held in the vessel 28a is always moved toward the developing roller 28b. The fur brush roller 28f is rotated in a direction indicated by an arrow $A_6$, and a bias voltage is applied thereto so that the toner particles entrained by the fur brush roller 28f are electrostatically moved from the fur brush roller 28f to the developing roller 28b.

In the operation of the developing device 28, when the photosensitive drum 24 is formed of an organic photoconductor (OPC) as mentioned above, a distribution of the negative charges is produced thereon, a charged area of which may have a potential of about −600 to −650 volts. In this case, the latent image zone formed on the drum 24 by the optical writing means may have a reduced potential of about −50 volts. On the other hand, the toner particles are given a negative charge by the triboelectrification with the developing roller 28b and the blade member 28c, and thus the open-cell foam rubber developing roller 28b is rotated within the developer, the toner particles are captured and held in the pore openings in the surface of the developing roller 28b to form a developer layer therearound. After the developer layer is formed, the thickness thereof is regulated by the blade member 28c, and it is then brought to the surface of the photosensitive drum 24.

A developing bias voltage of −350 volts (note, this developing bias voltage may be from about −200 to −500 volts) is applied to the developing roller 28b, so that the toner particles carried to the surface of the photosensitive drum 24 are electrostatically attracted only to the latent image zone, as if the latent image zone or low potential zone (−50 volts) is charged with the negative toner particles, whereby the toner developed image or toner image can be obtained as a visible image. As mentioned above, the remaining toner particles not used for the development are mechanically removed from the developing roller 28b by the toner-removing roller 28d, but in the embodiment of FIG. 2, the remaining toner particles can be also electrostatically removed from the developing roller 18 by applying a bias voltage of −200 volts (note, this bias voltage may be from about −150 to −400 volts) to the toner-removing roller 28d. Since the developer layer formed of the remaining toner particles is subjected to mechanical and electrical affects during the developing process, it should be removed from the developing roller 18 and a fresh developer layer formed thereon. The toner particles forming the fresh developer layer are electrostatically fed by the fur brush roller 28f to which a bias voltage, for example, −400 volts, lower than the developing bias voltage of −350 volts, is applied.

When the blade member 28c is formed of the conductive material, a bias voltage of −450 volts (note, this bias voltage may be from about −200 to −500 volts) may be applied thereto so that the charged toner particles are prevented from being electrostatically adhered to the blade member 28c. This is because, when the blade member has a relatively opposite polarity with respect to a potential of the developing bias voltage applied to the developing roller 28b, the toner particles are electrostatically adhered to the blade member 20c, to thereby hinder an even formation of the developer layer around the developing roller 28b. The application of the bias voltage to the blade member 20c also may contribute to the charging of the toner particles by a charge-injection effect.

Note, when the photoconductive drum 24 is formed of, for example, a selenium photoconductor, on which a distribution of positive charges is produced, the toner particles are positively charged and a positive bias voltage is applied to the developing roller 28b and the blade member 28c.

When the developed image or toner image reaches the transfer charger 30 due to the rotation of the photosensitive drum 24, the paper P, which has been released from the standby-condition, is introduced into a clearance between the drum 24 and the transfer charger 30. The transfer charger 30, which may also comprise a corona discharger, is arranged to give the paper P an electric charge having a polarity opposite to that of the toner image. That is, the transfer charger 30 gives the positive charge to the paper P, whereby the toner image is electrostatically transferred to the paper P. The paper P carrying the transferred toner image is then passed through a toner image fixing device 34, which comprises a heat roller 34a and a backup roller 34b. In particular, the toner particles forming the transferred toner image are heat-fused by the heat roller 34a so that the toner image is heat-fixed on the paper P. The residual toner particles not transferred to the paper P are removed from the surface of the photosensitive drum 24 by the cleaner 32, which may comprise a fur brush (not shown).

The cleaned surface of the photosensitive drum 24 is illuminated by a suitable lamp (not shown), to eliminate the charge therefrom, and is then given a negative charge by the charger 12. Note, in FIG. 1, reference numeral 36 designates a guide plate forming a travel path of the paper P between the transfer charger 30 and the toner image fixing device 34. As shown in FIG. 1, the paper P carrying the fixed toner image is then travelled to a paper-receiving station 38 provided in a top wall of the frame housing 12, through a pair of feed rollers 40, a guide path 42, and a pair of feed rollers 44.

Figure 4:
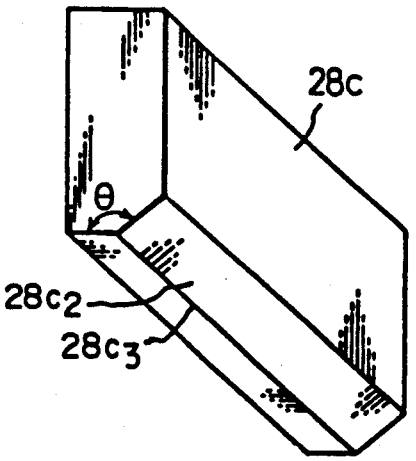
FIG. 4 is an enlarged perspective view showing the blade member of FIG. 3.

According to the present invention, the blade member 28*c* is shaped as shown in FIG. 4. Namely, the blade member 28*c* is in the form of a rectangular plate element, and a slant face $28c_2$ is formed at the bottom end face side of the blade member 28*c* so that an obtuse angle $\theta$ is defined between the slant face $28c_2$ and the bottom end face of the blade member 28*c*, whereby an obtuse angle edge $28c_3$ is formed therebetween. As shown in FIG. 3, the blade member 28 is arranged so that the slant face $28c_2$ thereof is in contact with the surface of the developing roller 28*b*, and thus a thickness of the developer layer formed around the developing roller 28*b* is regulated by the obtuse angle edge $28c_3$ of the blade member 28*c*.

Figure 5:
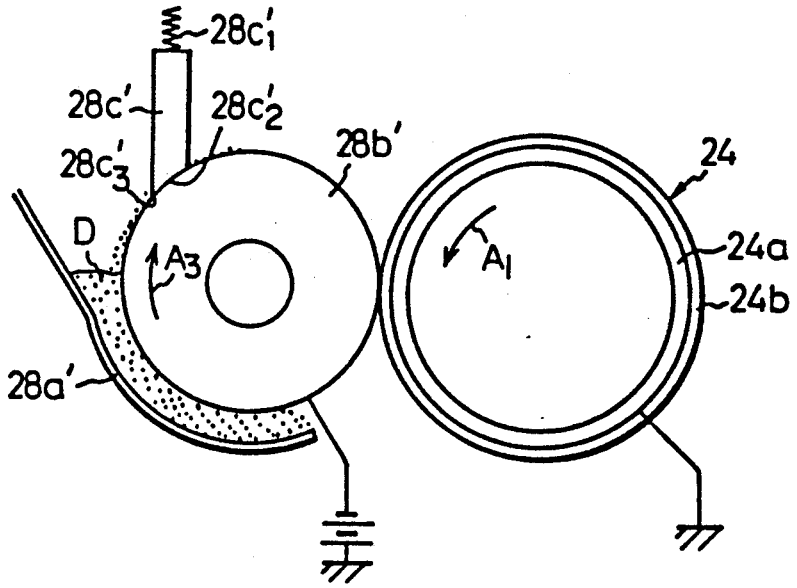
FIG. 5 is a schematic view showing a developing device to which a prior blade member is applied.
Figure 6:
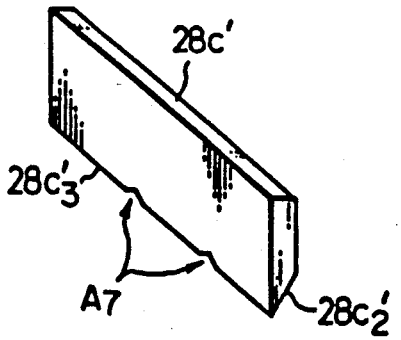
FIG. 6 is an enlarged perspective view showing the prior blade member of FIG. 5.

FIG. 5 shows a developing device, as disclosed in the above-mentioned Publication No. 62-96981, which comprises a vessel 28*a*' for receiving a non-magnetic type one-component developer D composed of toner particles, a developing rubber roller 28*b*' rotatably provided within the vessel 28*a*' for entraining the toner particles to form a developer layer around the developing roller 28*b*', and a rubber blade member 28*c*' resiliently engaged with the surface of the developing roller 28*b*' to regulate a thickness of the developer layer therearound. Similar to the developing device 28 of FIG. 2, this developing device is also resiliently biased toward the photosensitive drum 24 so that the developing roller 28*b*' is resiliently pressed thereagainst. During the development process, the developing roller 28*b*' is rotated in the direction indicated by the arrow $A_3$, and the developer layer thickness is regulated by the blade member 28*c*', which is siliently biased against the developing roller 28*b* by a spring means $28c_1$'. As shown in FIGS. 5 and 6, a bottom end face of the blade member 28*c*, which is in contact with the developing roller 28*b*, is formed as a slant face $28c_2$' so that the blade member 28*c* has an acute angle edge $28c_3$' at the bottom end face thereof. Thus, in the developing device shown in FIG. 5, the regulation of the developer layer thickness is carried out by the acute angle edge $28c_3$' of the blade member 28*c*'.

As easily understood, the acute angle edge $28c_3$' of the blade member 28*c*' is very susceptible to mechanical damage, in comparison with the obtuse angle edge $28c_3$ of the blade member 28*c* according to the present invention, and when the acute angle edge $28c_3$' of the blade member 28*c*' is chipped away, as indicated by arrows $A_7$ in FIG. 6, an even regulation of the developing layer thickness cannot be ensured.

Figure 7:
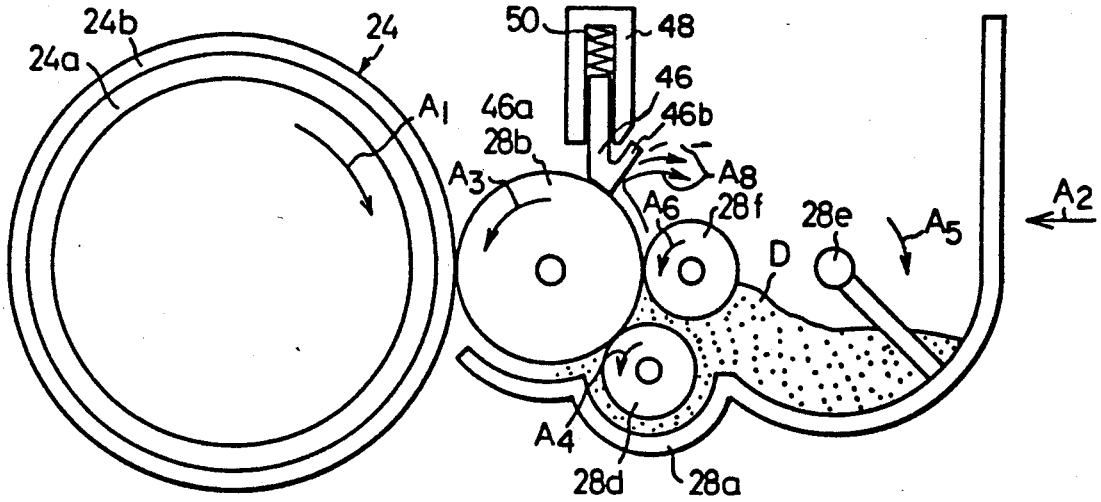
FIG. 7 is a schematic view showing a second embodiment of a developing device according to the present invention.

FIG. 7 shows a second embodiment of a developing device according to the present invention, which is substantially identical to the first embodiment of FIG. 2 except that a blade member 46 is used instead of the blade member 28*c* to regulate the developer layer thickness. Note, in FIG. 7, elements similar to those of FIG. 2 are indicated by the same reference numerals.

Figure 8:
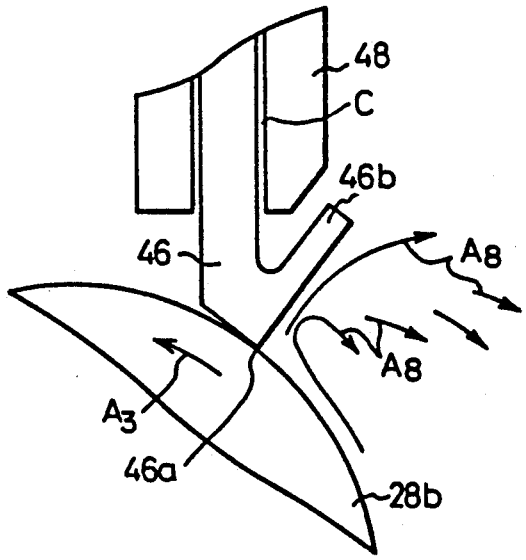
FIG. 8 is a partially enlarged view of FIG. 7, showing a developing roller and a blade member resiliently engaged therewith.

In the embodiment of FIG. 7, the blade member 46 is slidably received in a guide holder member 48 which is supported by the vessel 28 through suitable supporting elements (not shown). The guide holder member 48 is provided with a spring means such as a compression coil spring element 50 by which the blade member 46 is resiliently pressed against the developing roller 28*b*. The blade member 46 features an obtuse angle edge 46*a* for regulating the developer layer thickness, as the blade member 28*c* of FIG. 2, but also features a plate element 46*b* by which the excess toner particles caused by the regulation of the developer layer thickness are actively returned to the developer D held in the vessel 28*a*, as indicated by arrows $A_8$ in FIGS. 7 and 8, whereby the toner particles are prevented from entering a clearance C (FIG. 8) between the blade member 46 and the guide holder member 48. Note, in the embodiment of FIGS. 7 and 8, although the plate element 46*b* is integrally formed with the blade member 46, it may be separately attached thereto.

Figure 9:
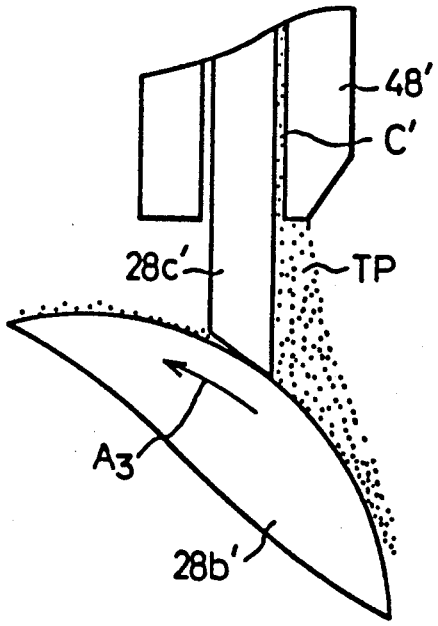
FIG. 9 is a schematic view showing a developing roller, a prior blade member resiliently engaged therewith, and a guide holder member for receiving the blade member.

FIG. 9 shows the blade member 28*c*' of FIG. 5 which is slidably received in a guide holder member 48' similar to the guide holder member 48. As apparent from this drawing, the excess toner particles TP caused by the regulation of the developer layer thickness cannot be prevented from entering a clearance C' between the blade member 28*c* ' and the guide holder member 48', and thus the blade member 28*c*' may become immovable in the guide holder member 48'. If the blade member 28*c*' become immovable, obviously it cannot follow the rotating surface of the developing roller 28*b*', and thus a proper regulation of the developer layer thickness cannot be ensured.

Figure 10:
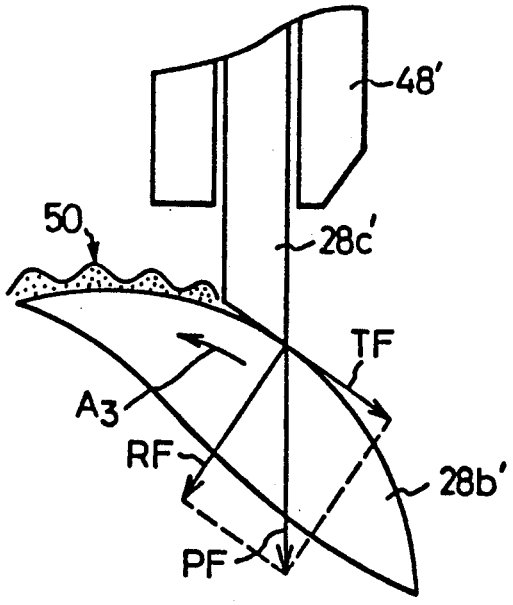
FIG. 10 is a view similar to FIG. 9 and explaining how a developer layer thickness regulated by the blade member is varied due to a frictional force between the blade member and the developing roller.

When using the blade members 28*c*, 46 and 28*c*' having the slant face resiliently pressed against the developing roller, these blade members may be vibrated by an increment of a frictional force between the blade member and the developing roller with the developer layer due to variations in the temperature and air moisture content. In particular, for example, when the blade member 28*c*' is resiliently pressed against the developing roller 28*b*' on the developing roller 28*b*' is divided into a radial component force RF and a tangential component force TF, as shown in FIG. 10. The radial component force RF serves to regulate the developer layer thickness, and the tangential component force TF serves to contradict a frictional force tangentially acting between the blade member 28*c*' and the developing roller 28*b*'. The frictional force between the blade member 28*c*' and the developing roller 28*b*' is incessantly variable, and includes a frictional radial component force which conforms with the radial component force RF, so that the resultant force (the radial component force RF plus the frictional radial component force) for regulating the developer layer thickness is also incessantly variable. Thus, a variation may appear in the regulated developer layer thickness, as symbolically indicated by reference numeral 50 in FIG. 10. Also, when the frictional force becomes large due to a rise in the temperature and air moisture content, so that it exceeds the tangential force TF, the blade member 28*c*' is lifted upward by the frictional force, and then moved downward by the spring means $28c_1$' (FIG. 5). In this case, the proper regulation of the developer layer thickness cannot be carried out. This also holds true for the blade members 28*c* and 46 according to the present invention.

Figure 11:
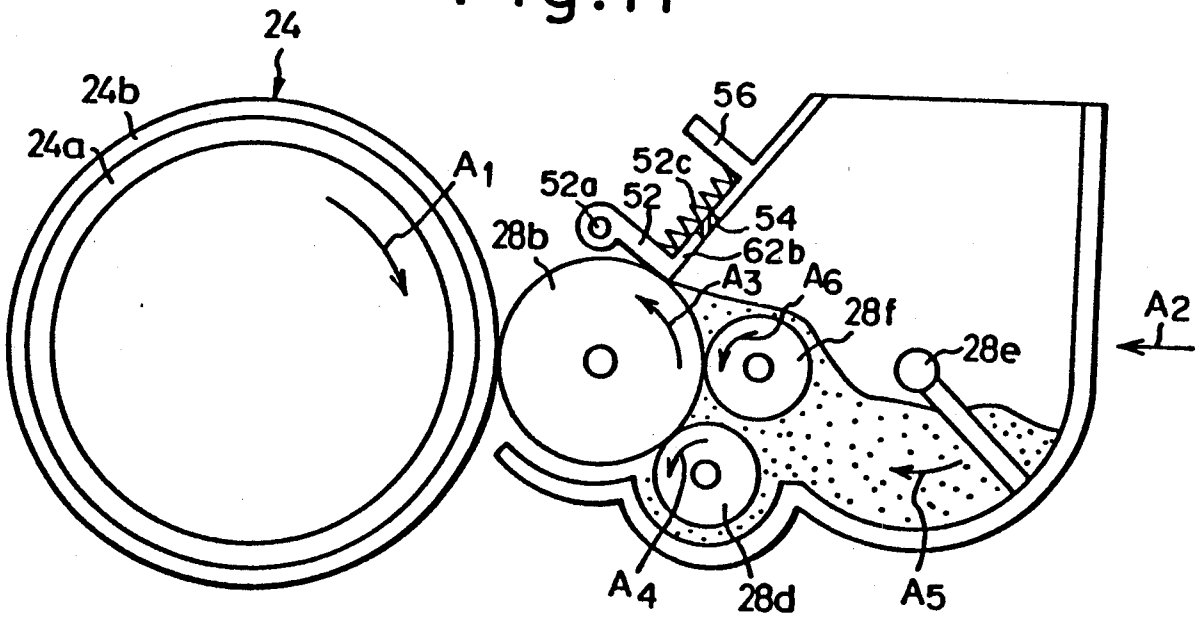
FIG. 11 is a schematic view showing a third embodiment of a developing device according to the present invention.

FIG. 11 shows a third embodiment of a developing device according to the present invention, which is substantially identical to the second embodiment of FIG. 7 except that a blade member 52 is used instead of the blade member 46 to regulate the developer layer thickness, and in which the blade member 52 is arranged so that a vibration thereof can be effectively prevented even though the frictional force between the blade member 52 and the developing roller 28*b* is increased. Note, elements in FIG. 11 similar to those of FIG. 7 are indicated by the same reference numerals.

In the embodiment of FIG. 11, the blade member 52 also is in the form of a rectangular plate element, but is pivotally mounted on a pivot pin 52*a* to be tangentially engaged with the surface of the developing roller 28*b*. Note, the pivot pin 52*a* is supported by the vessel 28*a* through suitable supporting elements (not shown). The blade member 52 has a plate element 52*b* integrally formed at the free end thereof and perpendicularly extended therefrom. An upper end of the plate element 52*b* is joined to a wall portion of the vessel 28*a* through the intermediary of a suitable flexible element 54 such as a flexible rubber sheet element, so that not only can the blade member 52 be pivoted about the pivot pin 52*a*, but also a leakage of the toner particles can be prevented by the flexible rubber sheet element 54 fixed between the plate element 52*b* and the vessel wall. Note, similar to the plate element 46*b* (FIG. 8), the plate element 52*b* serves to return the excess toner particles (caused by the regulation of the developer layer thickness) to the developer held in the vessel 28*a*. As shown FIG. 11, the blade member 52 is provided with a spring means, such as a compression coil spring 52*c*, between the blade member 52 and a wall element 56 protruded from the vessel wall portion, whereby the blade member 52 is resiliently pressed against the developing roller 28*b*.

Figure 12:
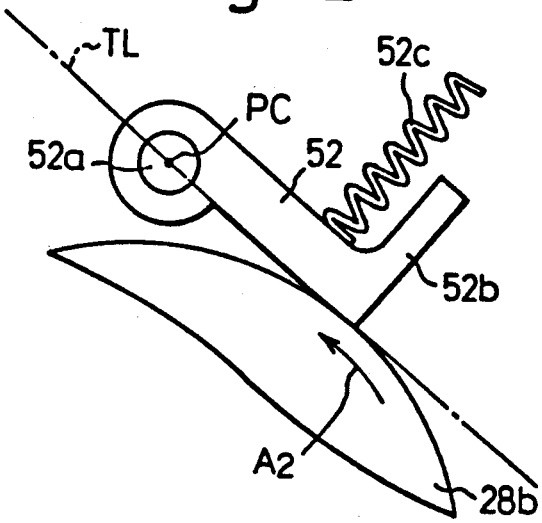
FIG. 12 is a partially enlarged view of FIG. 11, showing a developing roller and a blade member resiliently engaged therewith.
Figure 13:
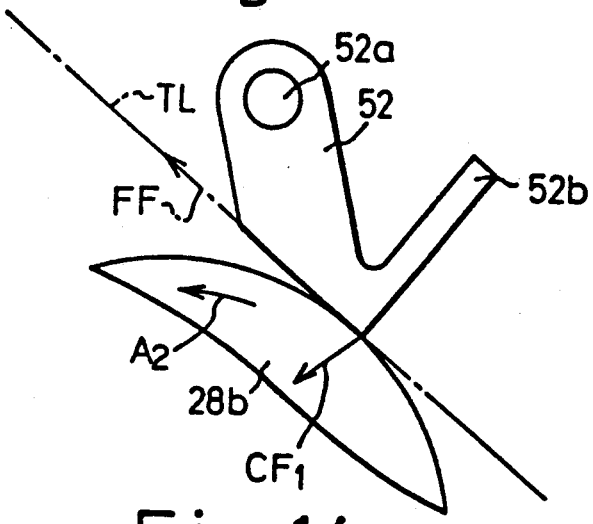
FIGS. 13 and 14 are reference views for explaining the technical merits of the third embodiment of FIGS. 11 and 12.
Figure 14:
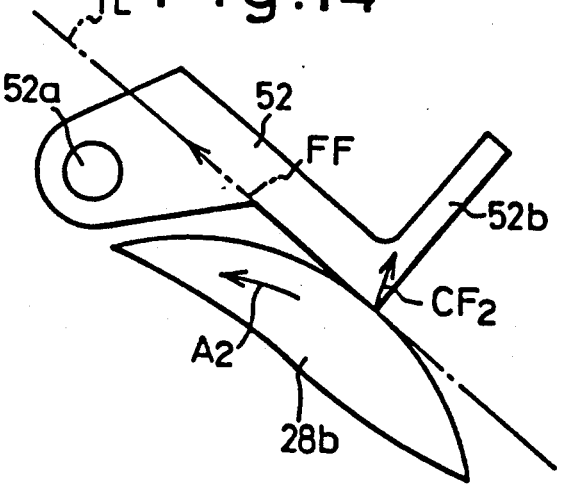

In the developing device of FIG. 11, the blade member 52 is characterized in that a pivot center PC of the pivot pin 52*a* is positioned on a tangential line TL defined between the blade member 52 and the developing roller 28*b*, as shown in FIG. 12, so that the blade member 52 cannot be subjected to a component of the frictional force between the blade member 52 and the developing roller 28*b*. Namely, since the blade member 52 is resiliently pressed against the developing roller 28*b* by only a resilient force resulting from the compression coil spring 52*c*, the force for regulating the developer layer thickness is not affected by the frictional force. If the blade member 52 is arranged so that the pivot pin 52*a* thereof is disposed above the tangential line TL, as shown in FIG. 13, the frictional force FF includes a component force $CF_1$ which conforms with the force for regulating the developer layer thickness, so that a variation appears in the regulated developer layer thickness as explained with reference to FIG. 10. Conversely, if the blade member 52 is arranged so that the pivot pin 52*a* thereof is disposed below the tangential line TL, as shown in FIG. 14, the frictional force FF includes a component force $CF_2$ which conforms with the force for regulating the developer layer thickness. Accordingly, in this case, a variation also appears in the regulated developer layer thickness.

Figure 15:
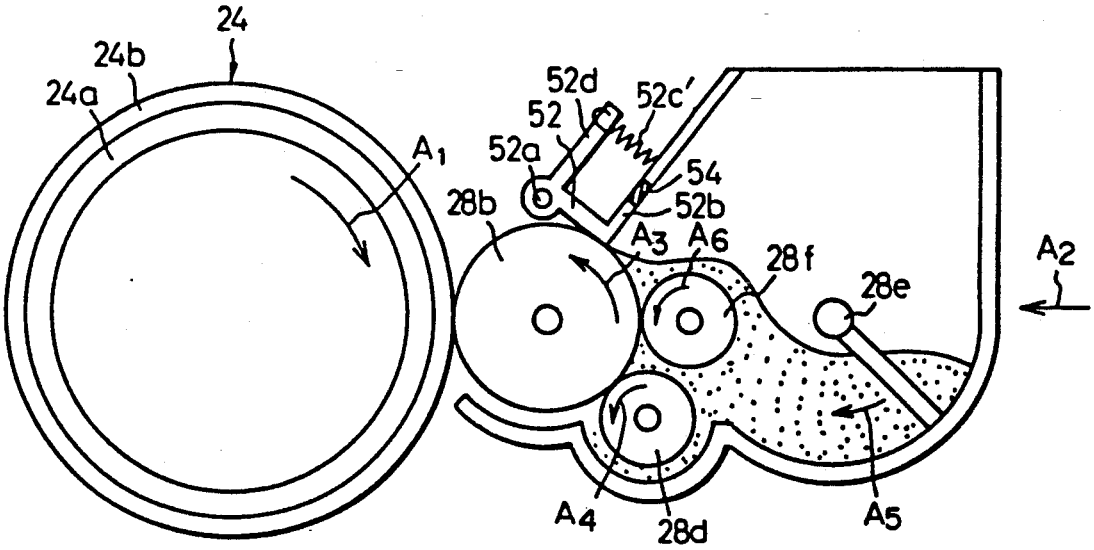
FIG. 15 is a schematic view showing a modification of the third embodiment of FIG. 11.

FIG. 15 shows a modification of the embodiment of FIG. 11, in which the blade member 52 is provided with a tension spring 52*c*', instead of the compression spring 52*c*, between the vessel wall portion and a projection element 52*d* protruded from the pivoted end of the blade member 52 in parallel with the plate element 52*b*. Namely, the modified embodiment of FIG. 15 is distinguished from that of FIG. 11 in that the blade member 52 is resiliently pressed against the developing roller 28*b* not by the compression spring 52*c* but by the tension spring 52.

Figure 16:
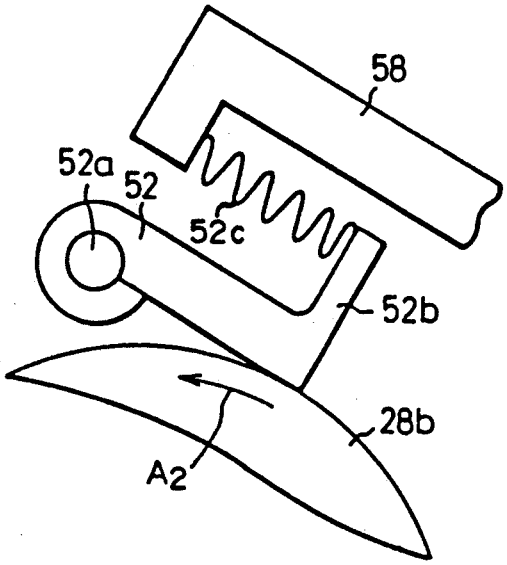
FIGS. 16, 17, and 18 are views showing variations of the blade member of FIG. 11.
Figure 17:
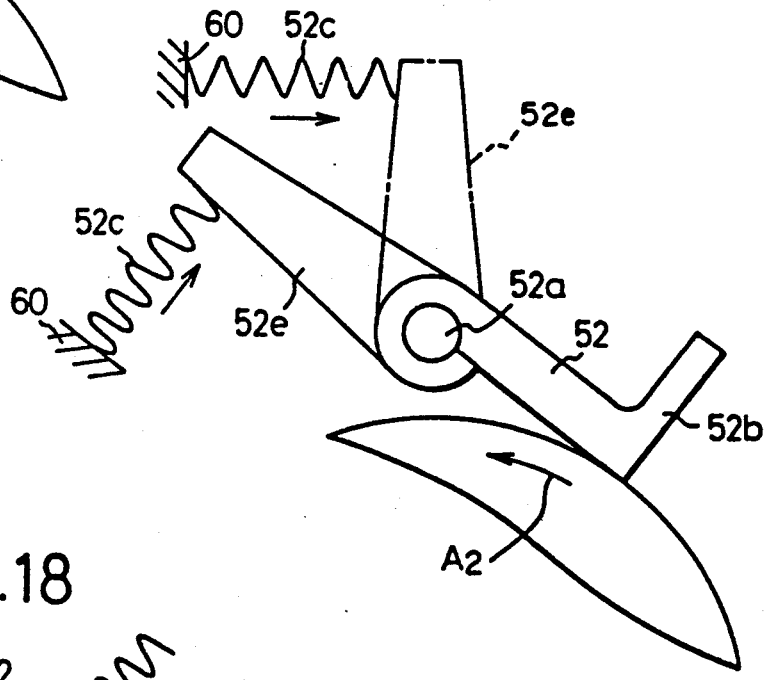
Figure 18:
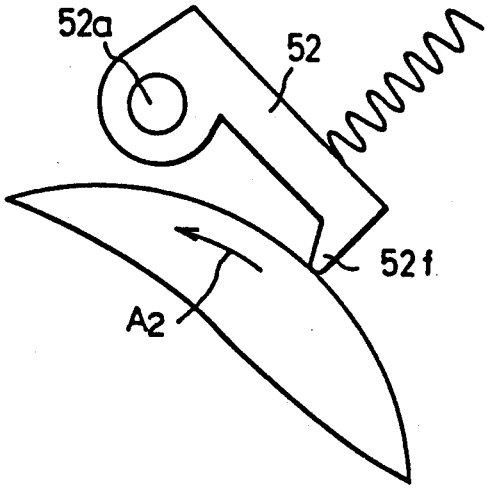

FIGS. 16, 17, and 18 show variations of the blade member 52 shown in FIG. 11. In FIG. 16, the compression spring 52*c* is located between the plate element 52*b* of the blade member 52 and a L-shaped element 58 protruded from the vessel wall portion, whereby the blade member is resiliently pressed against the developing roller 28*b*. In FIG. 17, the blade member 52 is provided with an arm element 52*e* extended from the pivoted end thereof, and the compression spring 52*c* is fixed between the arm element 52*c* and a suitable structure portion 60 which may be a part of the frame of the electrophotographic printer (FIG. 1). The arm element 52*e* may be angularly extended from the pivoted end of the blade member 52, as shown by a chain line in FIG. 17. Note, the blade member 52 as shown in FIGS. 11, 15, 16, and 17 also features the obtuse angle edge or right angle edge for regulating the thickness of the developer layer formed around the developing roller 28*d*. In FIG. 18, the blade member 52 features a round edge element 52*f* having a wedge-shaped cross section and resiliently pressed against the developing roller 28*b* by the compression spring 52*c*. The round edge element 52*f* serves to regulate the developer layer thickness, and is not susceptible to mechanical damages due to the roundness thereof.

Figure 19:
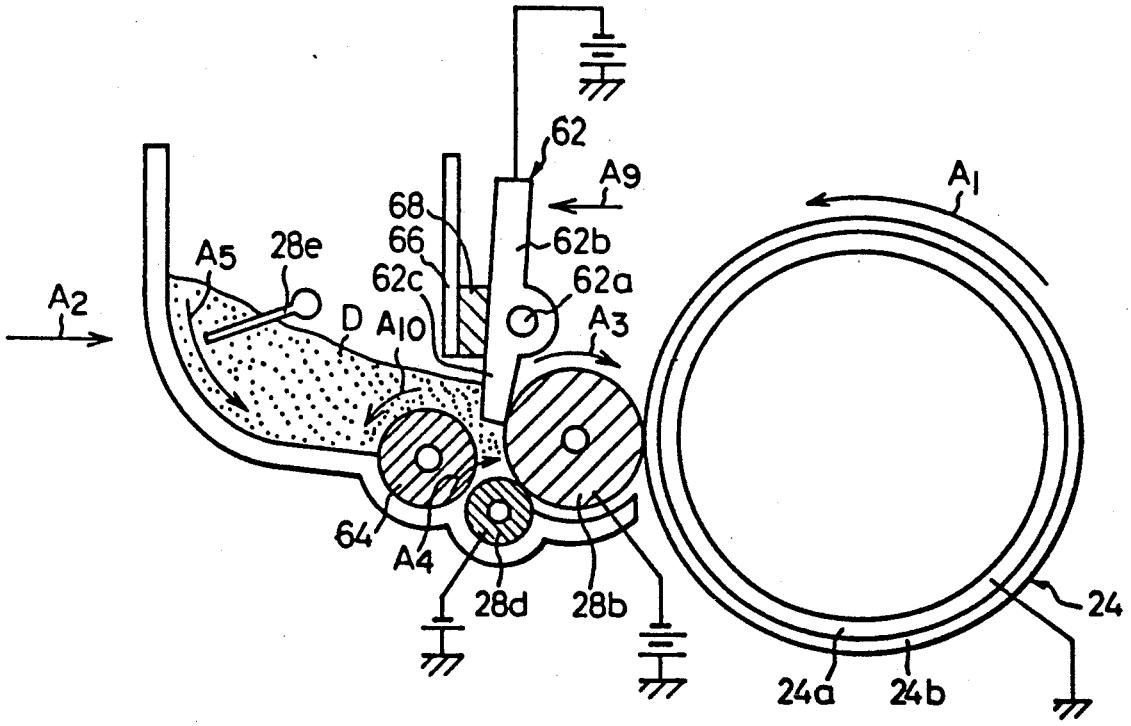
FIG. 19 is a schematic view showing a fourth embodiment of a developing device according to the present invention.

FIG. 19 shows a fourth embodiment of a developing device according to the present invention, which is substantially identical to the embodiment of FIG. 2 except that a two-arm blade member 62 is used instead of the blade member 28*c*, and that a paddle roller 64 is substituted for the fur brush roller 28*f*. The two-arm blade member 62 is pivotally mounted on a pivot pin 62*a* supported by the vessel 28*a*, and one blade arm 62*b* of the blade member 62 is resiliently biased in a direction indicated by an arrow $A_q$ so that the other blade arm 62*c* of the blade member 62 is resiliently pressed against the developing roller 28*b*. The two-arm blade member is characterized in that the blade arm 62*c* thereof has an obtuse angle edge for regulating the thickness of the developer layer formed around the developing roller 28*b*, and that a center of the pivot pin 62*a* is positioned on a tangential line defined between the blade arm 62*c* and the developing roller 28*b*.

The developing device of FIG. 19 is provided with a partition element 66 disposed within the vessel 28*a* adjacent to the blade member 62, and a stopper member 68 made of a foam rubber material or sponge material is disposed between the partition element 66 and the two-arm blade member 62, so that the developer D is prevented from entering a space therebetween. The paddle roller 64 is rotated in a direction indicated by an arrow $A_{10}$, so that the toner particles are fed to the developing roller 28*b*.

In the embodiments as mentioned above, the toner particles can be charged by a charge-injection effect obtained from an application of a bias voltage to the conductive blade member and/or by a triboelectrification with the blade member. In this case, the blade member must be suitably constituted in such a manner that the toner particles forming the regulated developer layer are given a charge distribution by which a proper development of the latent image can be ensured, because the constitution of the blade member has a great affect on the charging of the toner particles, as discussed hereinafter.

Figure 20:
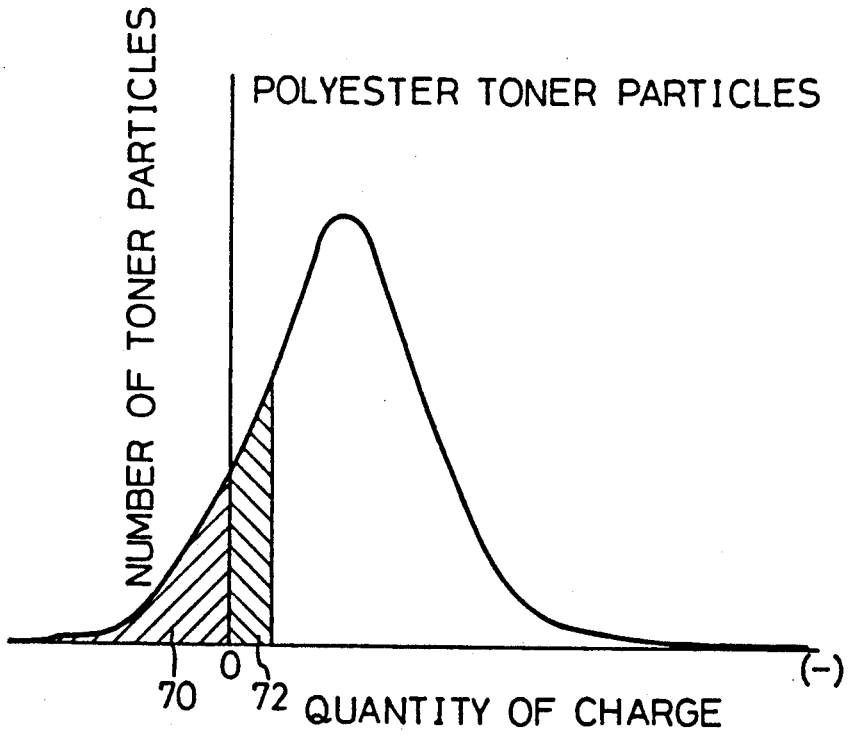
FIG. 20 is a graph showing a charge distribution of polyester resin-based toner particles when charged by a charge-injection effect obtained by an application of a bias voltage to a metal blade member.

For example, when a polyester resin-based toner developer is negatively charged by mainly the charge-injection effect, a bias voltage of about −300 volts must be applied to the conductive or metal blade member. In this case, the polyester resin-based toner particles are given a charge distribution as shown in FIG. 20, in which the abscissa and the ordinate indicate a quantity of charge and a number of toner particles, respectively. As apparent from this drawing, the polyester resin-based toner particles contain not only a positively-charged part of the toner particles indicated by reference numeral 70, but also a low-level negatively-charged part of the toner particles indicated by reference numeral 72. This is because an electrical discharge between the blade member and the developing roller occurs due to a large potential difference between the bias voltage applied to the blade member and the developing bias voltage applied to the developing roller, whereby a part of the polyester resin-based toner particles is given a positive charge.

Figure 21:
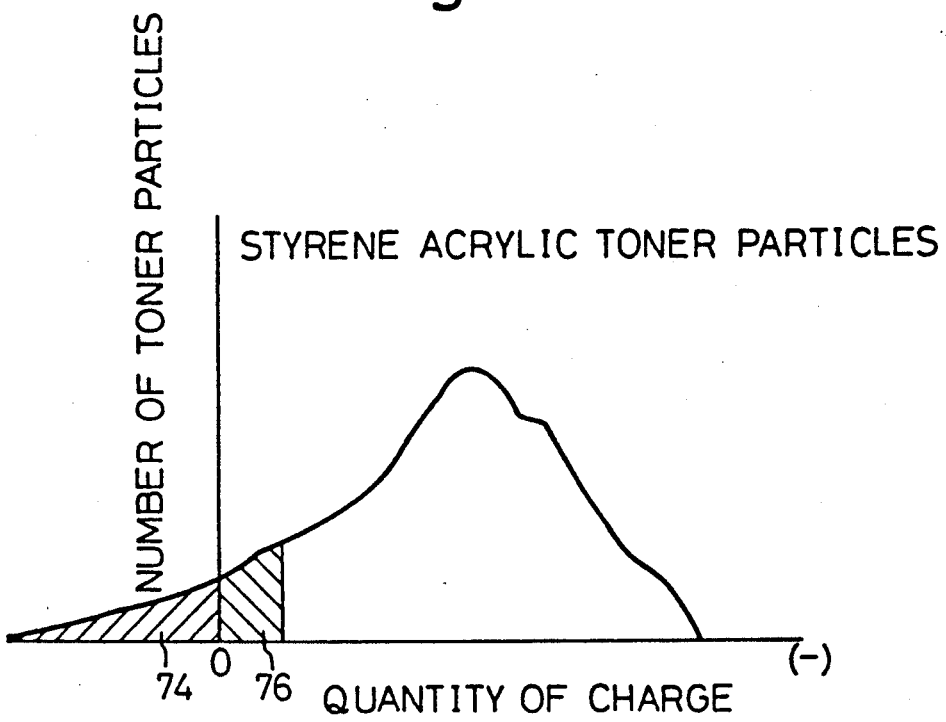
FIG. 21 is a graph showing a charge distribution of styrene acrylic resin-based toner particles when charged by a triboelectrification with a Teflon-coated blade member.

On the other hand, when the toner particles are charged by only the triboelectrification with the non-conductive resin blade member, an electrical discharge between the non-conductive resin blade member and the developing roller may occur because the non-conductive resin blade member is electrically floated, and thus is over-charged. When the electrical discharge occurs, the toner particles are given a positive charge, as mentioned above. When using the conductive resin blade member instead of the non-conductive resin blade member, an electrical discharge between the conductive resin blade member and the developing roller can be avoided because the conductive resin blade member cannot be over-charged. Nevertheless, when the conductive resin blade member is not formed of a suitable material, it is impossible to give the toner particles a charge distribution necessary for a proper development of the latent image. For example, when a styrene acrylic resin-based toner developer is negatively charged by a triboelectrification with a conductive Teflon blade member, the styrene acrylic resin-based toner particles are given a charge distribution as shown in FIG. 21, in which the abscissa and the ordinate indicate a quantity of charge and a number of toner particles, respectively. As apparent from this drawing, the styrene acrylic resin-based toner particles also contain not only a positively-charged part of the toner particles indicated by reference numeral 74, but also a low-level negatively-charged part of the toner particles indicated by reference numeral 76. This is because the Teflon, upon which the blade member is based, is negative-high with regard to frictional electrification, whereby a part of the styrene acrylic resin-based toner particles is given a positive charge.

The charge distributions of the toner particles shown in FIGS. 20 and 21 are disadvantageous because the positively-charged toner particles and the low-level negatively-charged toner particles may adhere to the surface of the photosensitive drum, except for the latent image zones, and thus the developer is prematurely consumed. Also, although the positively-charged toner particles adhered to the photosensitive drum cannot be transferred to a sheet or paper, the low-level negatively-charged toner particles can be transferred from the photosensitive drum to the sheet or paper, thereby causing an electrophotographic fog to appear thereon.

Accordingly, the constitution of the blade member must be taken into consideration before a charge distribution of the toner particles necessary for a proper development of the latent image can be obtained.

Figure 22:
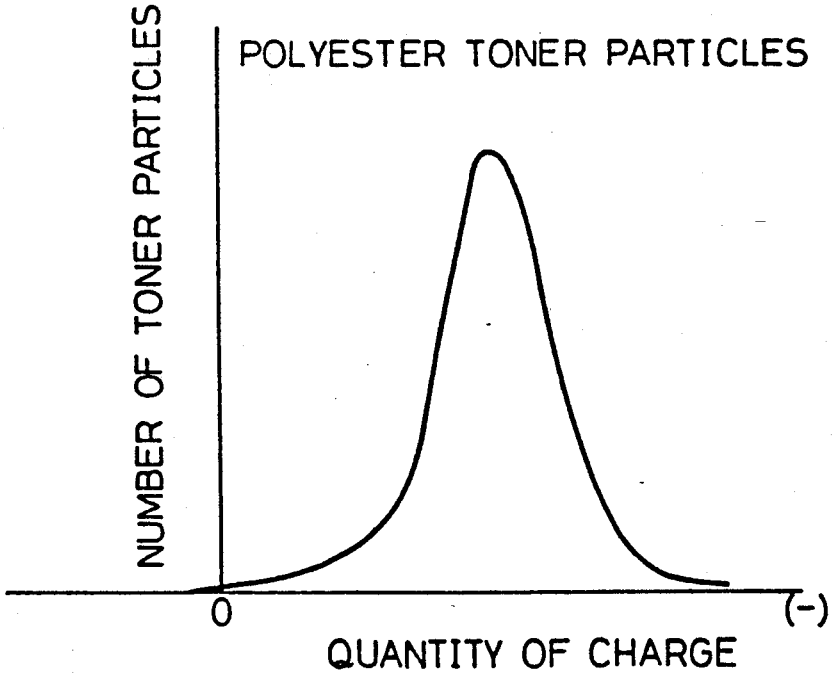
FIG. 22 is a graph showing a charge distribution of the polyester resin-based toner particles when charged by a triboelectrification with a conductive nylon blade member.
Figure 23:
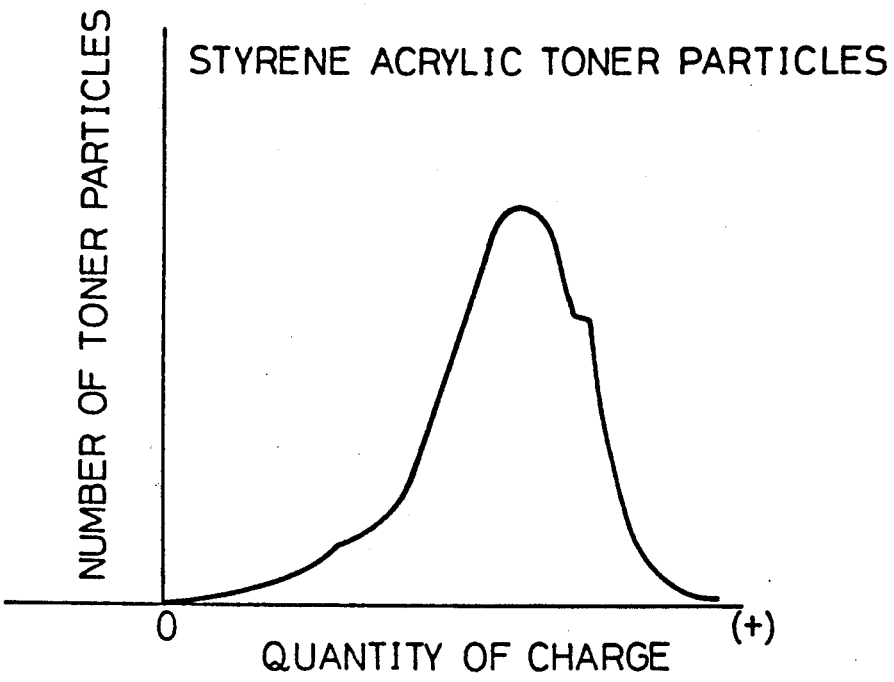
FIG. 23 is a graph showing a positive charge distribution of the styrene acrylic resin-based toner particles when charged by a triboelectrification with a Teflon-coated blade member.

For example, when the polyester resin-based toner particles are negatively charged by a triboelectrification with a conductive nylon blade member which is positive-high with regard to frictional electrification, the polyester resin-based toner particles can be given a charge distribution as shown in FIG. 22, by which a proper development of the latent image can be ensured. As apparent from this drawing, the polyester resin-based toner particles contain no part of toner particles having a positive charge. Also, FIG. 23 shows a positive charge distribution of the styrene acrylic resin-based toner particles positively charged by a triboelectrification with a conductive Teflon blade member, which is negative-high with regard to frictional electrification. According to this positive charge of distribution, a proper development of an electrical latent image formed on a positive charge area can be carried out.

Figure 24:
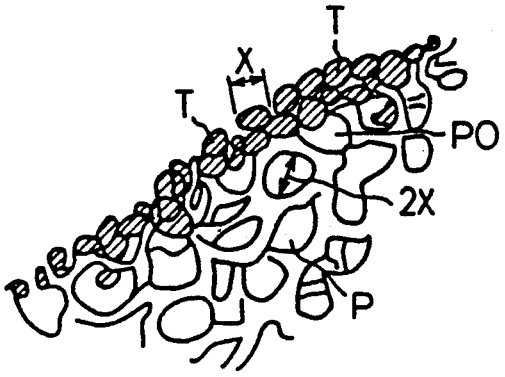
FIG. 24 is a partially enlarged schematic sectional view showing a conductive open-cell foam rubber developing roller.

As stated hereinbefore, preferably the roller element of the developing roller **28*b* is made of a conductive open-cell foam rubber material. In this case, as shown in FIG. 24, pore openings PO in the open-cell foam rubber developing roller 28*b* should have a diameter which is at most twice an average diameter X of the toner particles T, because a penetration of the toner particles into the open-cell foam rubber developing roller 28*b* can be prevented because the toner particles captured in the pore opening interfere with each other during the penetration thereof into the cells of the developing roller. Namely, a softness of the roller element of the developing roller 28*b* can be maintained since it is not hardened by the penetration of the toner particles therein, whereby a long operating life of the developing roller can be ensured and a proper development can be maintained, as easily understood from the following descriptions with reference to FIGS. 25 and 26**.

Figure 25:
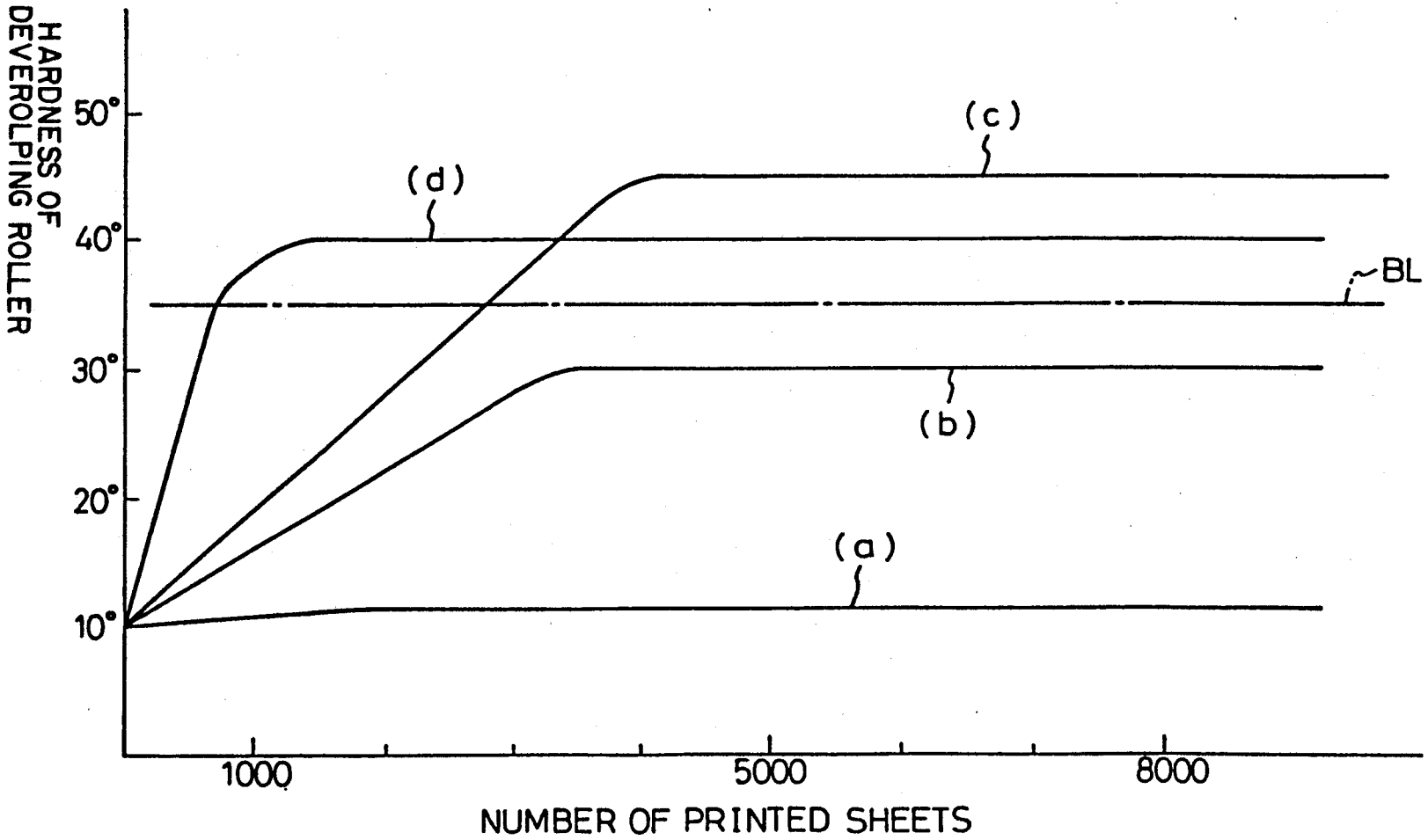
FIG. 25 is a graph showing how a hardness of each of conductive open-cell foam rubber developing rollers having pore openings or cell diameters of 10, 20, 50, and 100 μm varies as a number of printed sheets is increased.
Figure 26:
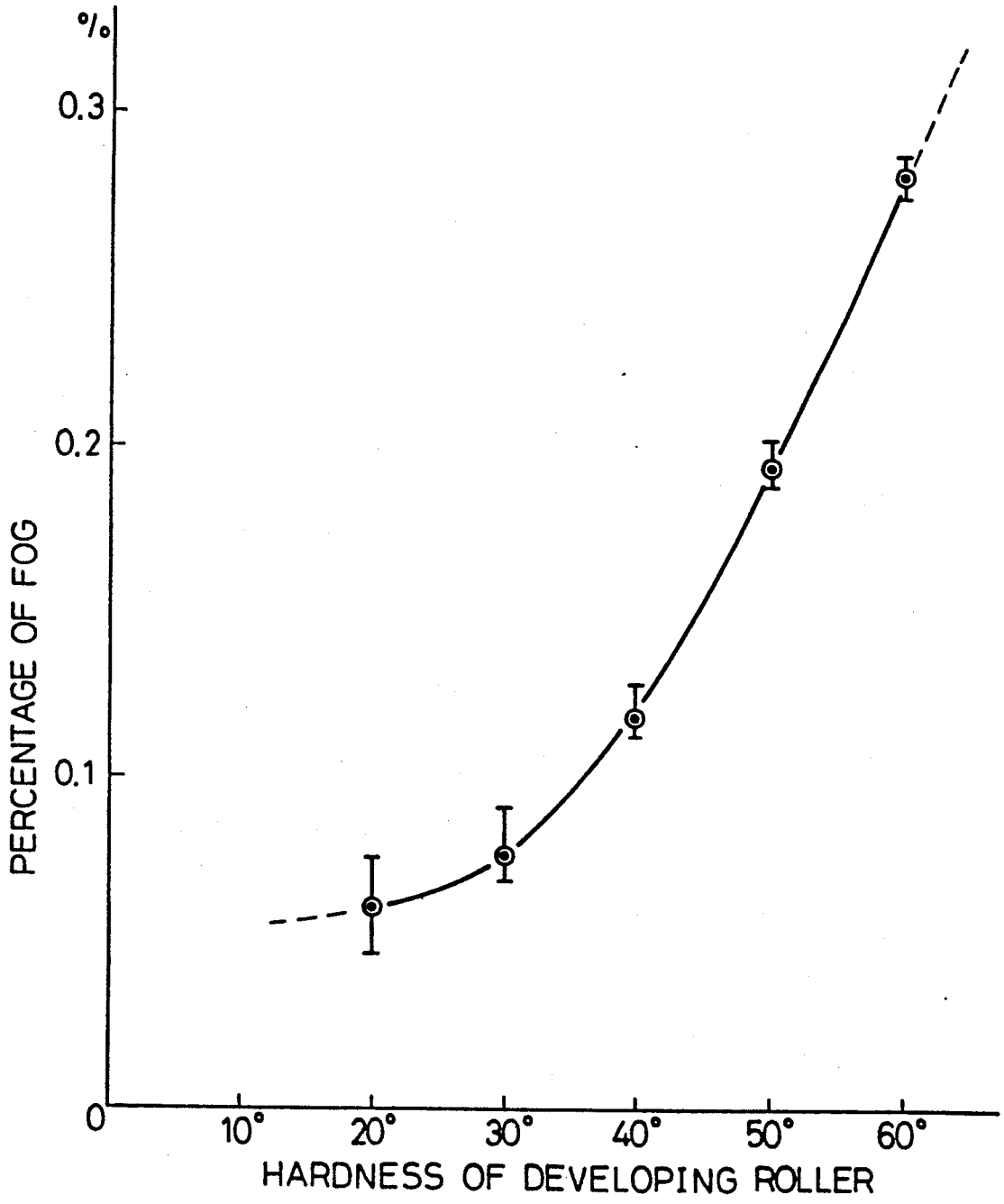
FIG. 26 is a graph showing how a percentage of electrophotographic fog which may appear during the development process varies as the hardness of the conductive porous rubber developing roller is raised.

FIG. 25 shows how a hardness of developing rollers having pore opening (cell) diameters of 10, 20, 50, and 100 μm varies as a number of printed sheets is increased, and FIG. 26 shows how a percentage of electrophotographic fog which may appear during the development process varies as a hardness of the developing roller is raised. Note, when the hardness of the developing roller becomes large due to the penetration of the toner particles therein, a force by which the toner particles are held at the surface of the developing roller is weakened, and thus some of the toner particles can be adhered to the surface zone of the photosensitive drum other than the latent image zone thereof, thereby causing the electrophotographic fog during the development process. In FIG. 25, (*a*), (*b*), (*c*), and (*d*) denote developing rollers having the pore opening (cell) diameters of 10, 20, 50, and 100 μm, respectively. Note, in tests carried out to obtain the results shown in FIGS. 25 and 26, toner particles having an average diameter of 10 μm were used. As apparent from FIG. 25, an initial hardness of the developing roller having a pore opening diameter of 10 μm is maintained even after the number of printed sheets has exceeded 8,000, which shows that there is very little penetration of the toner particles into the pore openings of the open-cell foam rubber developing roller. The hardness of the developing rollers having the pore opening diameters of 20, 50, and 100 μm is gradually increased until the number of printed sheets reaches about 3,500, 4,000, and 1,500, respectively, and then constantly maintained. This, of course, means that each of these developing rollers has been hardened by the penetration of the toner particles into the pore openings thereof. As apparent from FIG. 26, the larger the hardness of the developing roller, the greater the increase in the percentage of electrophotographic fog. For example, if an electrophotographic fog of 0.1% is permissible, the hardness of the developing roller may be increased to the toner particles into the pore openings thereof. Accordingly, a developing roller having pore opening diameters of at most 20 μm, the hardness of which does not exceed a border line BL of 35° shown in FIG. 25, is most preferable.

Figure 27:
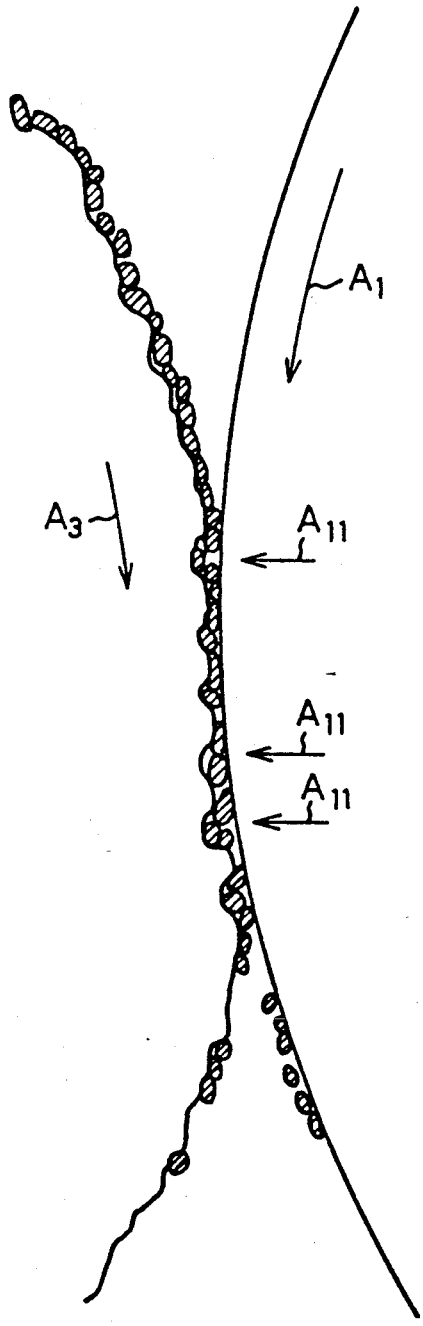
FIG. 27 is a partially enlarged schematic sectional view showing a developing or contact area between a photosensitive drum and the porous rubber developing roller resiliently pressed thereagainst.

When the pore opening diameter of the developing roller is more than twice the average diameter of the toner particles, or when the pore diameter of the developing roller is more than 20 μm, this brings the disadvantage of an uneven development of the latent image. In particular, as shown in FIG. 27, the electric field produced by applying the developing bias voltage to the developing roller **28*b* is weakened at locations (indicated by arrows $A_{11}$) at which the pore openings have a diameter of more than 20 μm, because of the larger space formed between the developing roller 28*b* and the photosensitive drum 24, and thus an amount of toner particles moved from the pore openings having a diameter of more than 20 μm toward the latent image zone of the drum 24** is reduced, whereby an uneven development of the latent image occurs.

When the diameter of the pore openings of the developing roller is less than one-fourth of the average diameter of the toner particles, it is impossible for the pore openings to capture the toner particles, and thus a sufficient amount of the toner particles cannot be entrained by the developing roller, whereby an underdevelopment occurs. Accordingly, in the developing roller, the diameter of the pore openings must be within from one-fourth to twice the average diameter of the toner particles.

Figure 28:
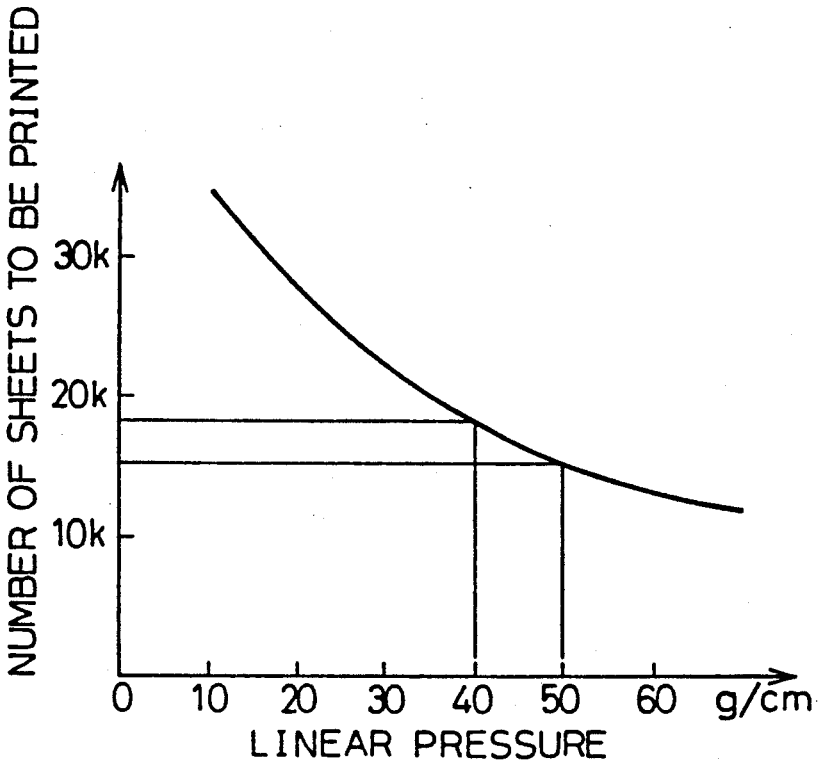
FIG. 28 is a graph showing a relationship between a linear pressure at which the developing porous rubber is pressed against the photosensitive drum and a maximum number of sheets which can be printed by the photosensitive drum.
Figure 29:
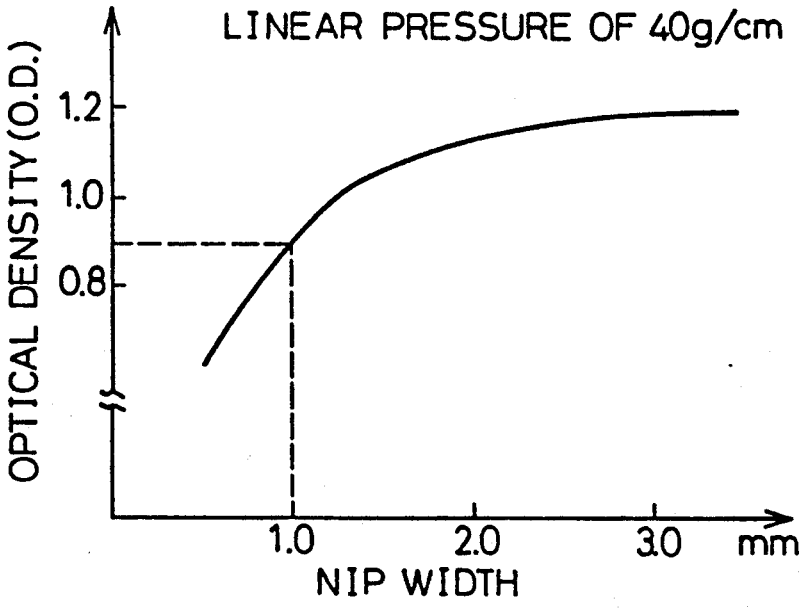
FIG. 29 is a graph showing a relationship between an optical density (O.D.) of a developed image and a contact or nip width between the porous rubber developing roller and the photosensitive drum.
Figure 30:
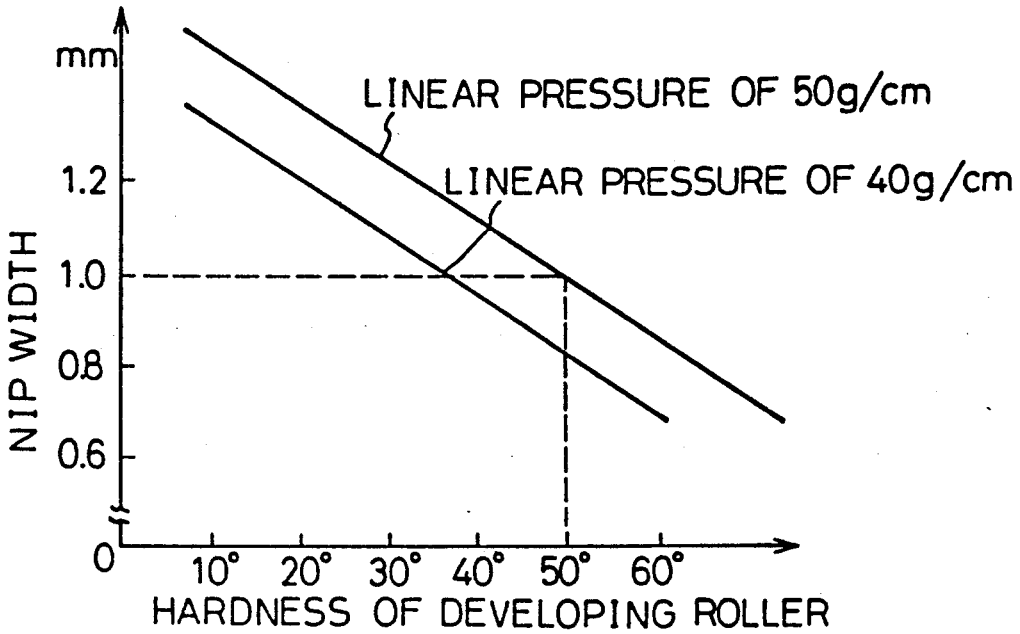
FIG. 30 is a graph showing a relationship between a hardness of the porous rubber developing roller and a nip width between the porous rubber developing roller and the photosensitive drum.

Also, according to the present invention, the developing roller **28*b* is constituted so as to be given an Asker C-hardness of at most 50°, preferably 35°, because the harder the developing roller 28*b*, the greater the wear of the photosensitive film 24*b* of the drum 24, whereby the operating life of the drum 24 is shortened. As shown in FIG. 28, the higher the linear pressure at which the developing roller is pressed against the photosensitive drum, the lower the number of sheets which can be printed by the photosensitive drum. For example, when the photosensitive drum is required to withstand a printing of more than 15,000 sheets, the developing roller must be pressed against the drum at a linear pressure of at most 50 g/cm. On the other hand, as shown in FIG. 29, the larger a contact or nip width between the developing roller and the drum, the higher an optical density (O.D.) of the developed image. For example, when the developing roller is pressed against the drum at a linear pressure of 40 g/cm, the nip width therebetween must be at least 1 mm before an optical density of more than about 0.9 necessary for the development process can be obtained. Note, a nip width of more than 1.5 mm is preferable for obtaining a developed image with a required optical density. Also, as shown in FIG. 30**, the lower the hardness of the developing roller, the larger the nip width between the developing roller and the drum. For example, when a developing roller having an Asker C-hardness of 50° is pressed against the drum at a linear pressure of 50 g/cm, the nip width therebetween is 1 mm, whereas when a developing roller having an Asker C-hardness of 40° is pressed against the drum at the same linear pressure, the nip width therebetween is 1.1 mm. Accordingly, the Asker C-hardness of the developing roller should be at most 50°, to enable the photosensitive drum to print more than 15,000 sheets. Note, preferably a developing roller having an Asker C-hardness of less than 35° is pressed against the drum in such a manner that the nip width therebetween is from 1 to 3.5 mm.

Figure 31:
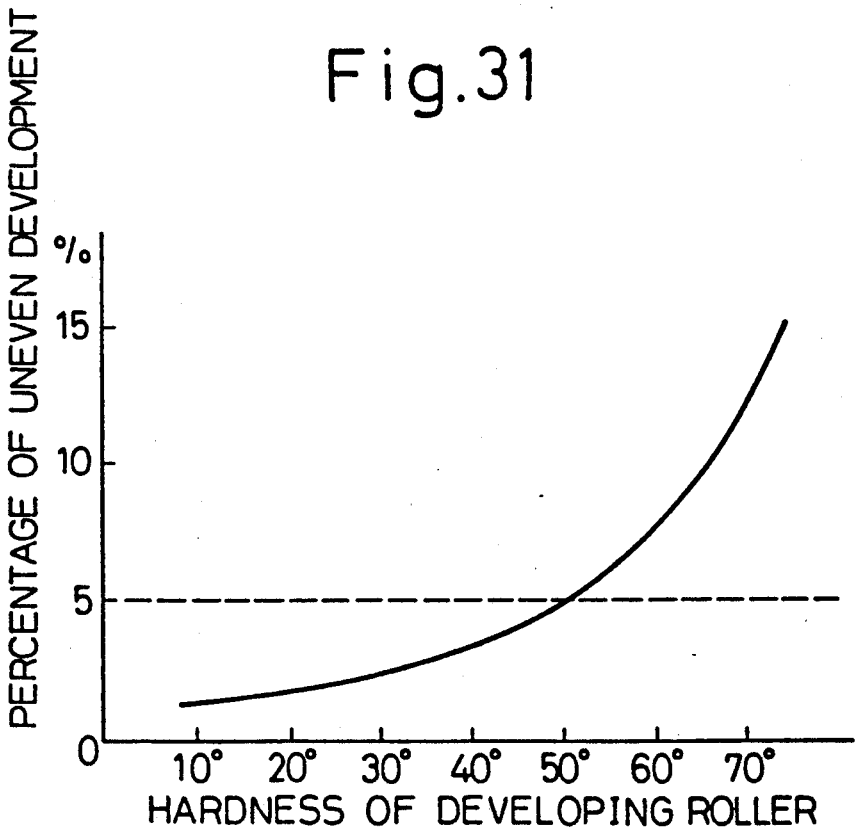
FIG. 31 is a graph showing a relationship between a hardness of the porous rubber developing roller and a percentage of uneven development.
Figure 32:
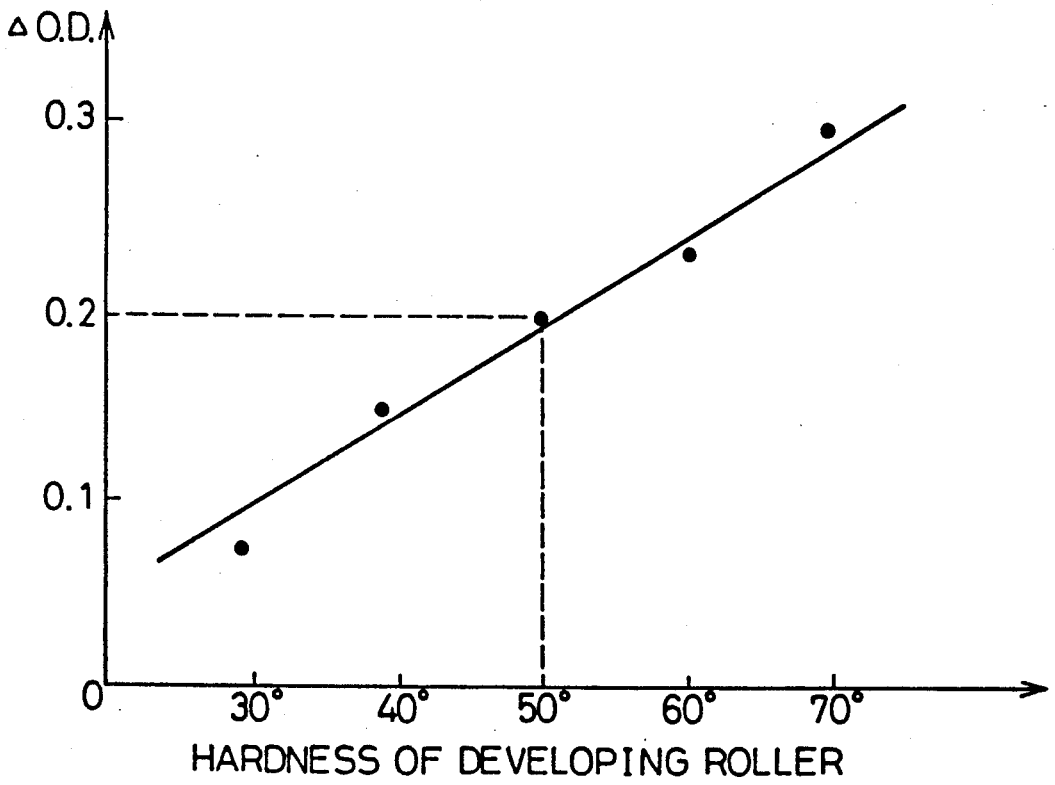
FIG. 32 is a graph showing a relationship between a hardness of the porous rubber developing roller and a difference between the highest and lowest optical densities when carrying out a solid printing of a sheet with a black developer.

When the blade member (**28*c*, 52, 62) is made of a metal material such as aluminum, stainless steel, brass or the like, the developing roller 28*b* must have an Asker C-hardness of at most 50°. The metal blade member has a treated and finished surface which is engaged with the developing roller to regulate the thickness of the developer layer formed therearound. In general, a possible accuracy of the finished surface of the metal blade member is on the order of about 30 μm, but this may be rough relative to toner particles having an average diameter of 10 μm, so that the regulated thickness of the developer layer is made uneven due to the rough surface of the metal blade member, to thereby cause an uneven development of the latent image. The greater the hardness of the developing roller, the greater the variation of the developer thickness, and thus the uneven development becomes more noticeable as shown in FIG. 31. In this drawing, the abscissa shows a hardness of the developing roller and the ordinate shows a percentage of uneven development when a sheet is printed solidly with a black developer. For example, if an uneven development of at most 0.5%, which is not visually noticeable, is permissible as indicated by a broken line in FIG. 31, the developing roller must have an Asker C-hardness of at most 50°. Also, FIG. 32 shows a relationship between a hardness of the developing roller and a difference (Δ O.D.) between the highest and lowest optical densities when printing a sheet solidly with a black developer. Similarly, the difference of 0.2 (Δ O.D.), which is not visually noticeable, corresponds to the Asker C-hardness of about 50°, as indicated by broken lines in FIG. 32**.

Figure 33:
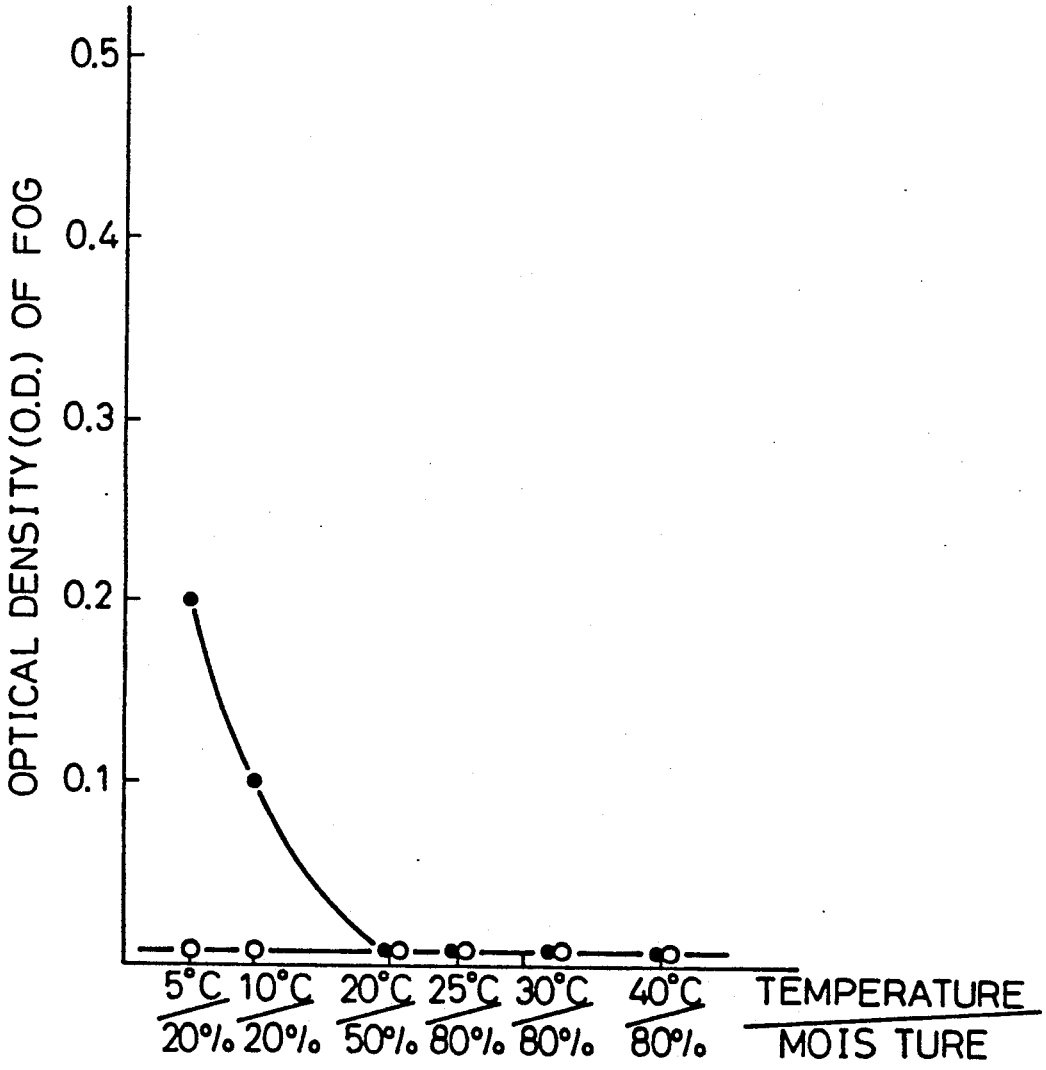
FIG. 33 is a graph showing a relationship between a variation of the temperature and air moisture content and an optical density (O.D.) of an electrophotographic fog appearing when using the porous rubber developing roller having an Asker hardness of 20° and the solid rubber developing roller having an Asker hardness of 58°.

In general, a hardness of the synthetic rubber material such as a polyurethane rubber material, upon which the open-cell foam rubber developing roller **28*b* according to the present invention and the conventional solid rubber developing roller as mentioned above may be based, is made greater by a drop in the temperature and air moisture content. Also, a coefficient of friction of the synthetic rubber material such as a polyurethane rubber material is lowered by a drop in the temperature and air moisture content, as mentioned above. As a result, when using the conventional solid rubber developing roller, a toner density for the development is lowered because the toner particles cannot be sufficiently entrained by the solid roller, and an electrophotographic fog appears because the toner particles cannot be firmly held by the solid rubber developing roller. On the contrary, regardless of variations of the temperature and air moisture content, the hardness of the developing roller according to the present invention cannot be greatly lowered because of the porous structure thereof, and the toner particles are easily captured and firmly held by the pore openings of the open-cell foam rubber developing roller. Thus, when the developing roller 28*b* as mentioned above is used, the electrophotographic fog can be substantially eliminated even though the temperature and air moisture content are varied. FIG. 33 shows a relationship between a variation of temperature and air moisture content and an optical density (O.D.) of an electrophotographic fog when using a conductive open-cell foam rubber developing roller having an Asker hardness of 20° and a solid rubber developing roller having an Asker hardness of 58°. Note, in FIG. 33, open circles and solid circles correspond to the porous rubber developing roller having an Asker hardness of 20° and the solid rubber developing roller having an Asker hardness of 58°, respectively. As apparent from FIG. 33**, when the open-cell foam rubber developing roller having an Asker hardness of 20° was used, the electrophotographic fog was substantially eliminated even though the temperature and air moisture content had dropped, whereas when the solid rubber developing roller having an Asker hardness of 58° was used, an optical density of the electrophotographic fog was gradually increased when the temperature and air moisture content fell below 25° C. and 50%, respectively.

Furthermore, according to the present invention, the developing roller 28*b* is formed of the conductive open-cell foam polyurethane rubber material, because another advantage of maintaining a resolution of a developed image, and therefore a printed image, at a high level and over a long period can be obtained. Variations of the resolution were measured where the polyurethane foam rubber developing roller and the silicone foam rubber developing roller were incorporated into electrophotographic printers having a dot density of 300 dpi (dots per inch). In the measurement, a sample pattern including a plurality of dot lines spaced from each other by a line space corresponding to the dot line was repeatedly printed out on a sheet or paper, and then a reflection densition DB (reflected light intensity) from the dot lines and a reflection density DW (reflected light intensity) from the line spaces were determined from the printed sample pattern. The resolution was evaluated by a percentage R obtained from the following formula:

$$R = \frac{\sum_{i=1}^{n} DW_i/n}{\sum_{i=1}^{n} DB_i/n} \times 100\ (\%)$$

Figure 34:
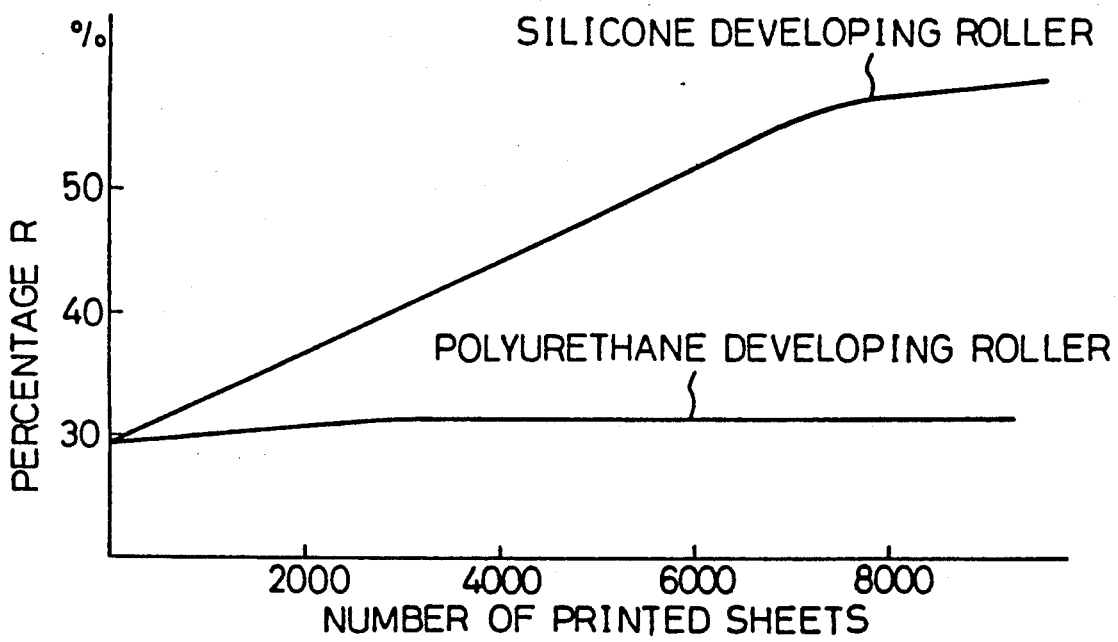
FIG. 34 is a graph showing how a resolving power of a developed image varies as a number of printed sheets is increased, when using the polyurethane foam rubber developing roller and the silicone foam rubber developing roller.

Wherein: "n" indicates a number of dot lines or line spaces. As apparent from this formula, the smaller the percentage R, the greater the resolution. Note, when the percentage R exceeds 60%, the resolution derived therefrom is practically unacceptable. The results of this measurement are shown in FIG. 34, and as shown in this drawing, when the polyurethane foam rubber developing roller is used, the percentage R is constantly maintained at 30% throughout a printing of more than 8,000 sheets, whereas when the silicone foam rubber developing roller is used, the percentage R is raised to the limit of 60% when the number of printed sheets reaches about 8,000. This is assumed to be because the polyurethane foam rubber developing roller has a superior wear resistance to the silicone foam rubber developing roller, whereby a surface characteristic of the silicone foam rubber developing roller is easily deteriorated by the frictional engagement with the photosensitive drum 24 and the blade member (28*c*, 52, 62), in comparison with the polyurethane foam rubber developing roller.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-compnent developer may be also used, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer, which device comprises:

a vessel for holding a one-component developer composed of toner particles;

a developing roller rotatably provided with said vessel in such a manner that a portion of said developing roller is exposed therefrom and faces a surface of an electrostatic latent image carrying body;

said developing roller being formed of a conductive rubber material by which the toner particles are entrained to form a developer layer therearound and carried to the surface of said electrostatic latent image carrying body for development of an electrostatic latent image formed thereon; and a blade member provided within said vessel and resiliently engaged with said developing roller for regulating a thickness of the developer layer formed therearound said blade member having a slant face formed thereon to define an obtuse angle edge, the slant face of said blade member being in resilient contact with the surface of said developing roller, whereby the regulation of the developer layer thickness is carried out.

2. A developing device as set forth in claim 1, wherein said developing roller is formed of a conductive open-cell foam rubber material so that pore openings appear over the surface of said developing roller, said pore openings having a diameter which is at most twice an average diameter of the toner particles, whereby during a rotation of said developing roller the toner particles are captured and held by the pore openings of said developing roller.

3. A developing device as set forth in claim 2, wherein said developing roller has an Asker C-hardness of at most 50°, preferably 35°, whereby the operating life of said electrostatic latent image carrying body can be prolonged.

4. A developing device as set forth in claim 3, wherein said blade member is formed of a metal material selected from the group consisting of aluminum, stainless steel, and brass, whereby variations of the developer layer thickness regulated by said blade member can be reduced.

5. A developing device as set forth in claim 2, wherein said conductive open-cell foam rubber material of which said developing roller is formed is a conductive open-cell foam polyurethane rubber material, whereby a resolution of a developed image can be maintained at a high level and over a long period.

6. A developing device as set forth in claim 1, wherein said blade member is based upon a conductive resin material so that the toner particles forming the developer layer regulated thereby are given a charge distribution by which a proper development of the electrostatic latent image can be ensured.

7. A developing device using a one-component developer, which device comprises:

a vessel for holding a one-component developer composed of toner particles;

a developing roller rotatably provided with said vessel in such a manner that a portion of said developing roller is exposed therefrom and faces a surface of an electrostatic latent image carrying body;

said developing roller being formed of a conductive rubber material by which the toner particles are entrained to form a developer layer therearound and carried to the surface of said electrostatic latent image carrying body for development of an electrostatic latent image formed thereon; and a blade member provided within said vessel and resiliently engaged with said developing roller for regulating a thickness of the developer layer formed therearound, said blade member being slidably received in a guide holder member, and having a plate element integrally formed therein to thereby rebound and return excess toner particles removed by said blade member to the developer held in said vessel, whereby the excess toner particles removed by said blade member from the developer layer are prevented from entering the guide holder member.

8. A developing device as set forth in claim 7, wherein said developing roller is formed of a conductive open-cell foam rubber material so that pore openings appear over the surface of said developing roller, said pore openings having a diameter which is at most twice an average diameter of the toner particles, whereby during a rotation of said developing roller the toner particles are captured and held by the pore openings of said developing roller.

9. A developing device as set forth in claim 8, wherein said developing roller has an Asker C-hardness of at most 50°, preferably 35°, whereby the operating life of said electrostatic latent image carrying body can be prolonged.

10. A developing device as set forth in claim 9, wherein said blade member is formed of a metal material selected from the group consisting of aluminum, stainless steel, and brass, whereby variations of the developer layer thickness regulated by said blade member can be reduced.

11. A developing device as set forth in claim 8, wherein said conductive open-cell foam rubber material of which said developing roller is formed is a conductive open-cell foam polyurethane rubber material, whereby a resolution of a developed image can be maintained at a high level and over a long period.

12. A developing device as set forth in claim 7, wherein said blade member is based upon a conductive resin material so that the toner particles forming the developer layer regulated thereby are given a charge distribution by which a proper development of the electrostatic latent image can be ensured.

* * * * *